US009335699B2

(12) United States Patent
Minoshima

(10) Patent No.: US 9,335,699 B2
(45) Date of Patent: May 10, 2016

(54) SHEET CONVEYER AND IMAGE FORMING APPARATUS

(71) Applicant: Saya Minoshima, Gifu (JP)

(72) Inventor: Saya Minoshima, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/939,253

(22) Filed: Jul. 11, 2013

(65) Prior Publication Data

US 2014/0016980 A1 Jan. 16, 2014

(30) Foreign Application Priority Data

Jul. 11, 2012 (JP) ..... 2012-155143

(51) Int. Cl.
*G03G 15/00* (2006.01)
*G03G 21/16* (2006.01)

(52) U.S. Cl.
CPC ..... *G03G 15/6511* (2013.01); *G03G 21/1695* (2013.01)

(58) Field of Classification Search
CPC ..... B65H 5/06; B65H 2404/152; B65H 2404/1521; B65H 2404/1523; B65H 2404/15213; B65H 2404/725; B65H 2404/741; B65H 3/0615; B65H 3/064; B65H 3/0607; G03G 15/6511; G03G 21/1695
USPC ..... 399/393; 271/9.01, 9.07, 9.08, 9.09, 13, 271/10.01, 18, 21, 10.09, 253, 226, 236, 271/240, 248, 162
See application file for complete search history.

(56) References Cited

U.S. PATENT DOCUMENTS 5,737,682 A * 4/1998 Yamagishi ..... 399/402
6,406,201 B1 * 6/2002 Beretta et al. ..... 400/605
7,673,872 B2 3/2010 Lee et al.

(Continued)

FOREIGN PATENT DOCUMENTS

CN 101164851 A 4/2008
JP 58-131234 9/1983

(Continued)

OTHER PUBLICATIONS

Jul. 2, 2015—(CN) The First Office Action—App 201310288889.3, Eng Tran.

(Continued)

*Primary Examiner* — Matthew G Marini
(74) *Attorney, Agent, or Firm* — Banner & Witcoff, Ltd.

(57) ABSTRACT

A sheet conveyer including a body, a conveyer to convey the sheet into a conveyer path formed in the body, a conveyer-supporting frame to support the conveyer, a first placement unit including a lifting plate movable between a separated position and an approximate position, and a lateral guide arranged on the lifting plate to be movable integrally with the lifting plate and slidably along a widthwise direction and configured to restrict a widthwise position of the sheet placed on the lifting plate and, is provided. The conveyer contacts the sheet placed on the first placement unit, when the lifting plate is in the approximate position, and conveys the contacting sheet into the conveyer path. The conveyer-supporting frame is formed to have an interference-avoidable dented section, in which the side guide on the lifting plate placed in the approximate position enters partly to avoid interference with the conveyer-supporting frame.

21 Claims, 12 Drawing Sheets

(56) References Cited

U.S. PATENT DOCUMENTS

| | | | | |
|---|---|---|---|---|
| 2004/0141789 | A1* | 7/2004 | Kelsay et al. | 400/605 |
| 2008/0093792 | A1 | 4/2008 | Lee et al. | |
| 2009/0001660 | A1* | 1/2009 | Miwa | 271/226 |
| 2009/0174133 | A1* | 7/2009 | Kim et al. | 271/9.02 |
| 2010/0059924 | A1* | 3/2010 | Shiohara et al. | 271/9.01 |
| 2011/0293316 | A1 | 12/2011 | Sato | |

FOREIGN PATENT DOCUMENTS

| | | | |
|---|---|---|---|
| JP | 2004-196516 | A | 7/2004 |
| JP | 2011-248137 | A | 12/2011 |

OTHER PUBLICATIONS

Mar. 4, 2016—(CN) The Second Office Action—App 201310288889.3, Eng Tran.

* cited by examiner

SHEET CONVEYER AND IMAGE FORMING APPARATUS

CROSS REFERENCE TO RELATED APPLICATION

This application claims priority from Japanese Patent Application No. 2012-155143, filed on Jul. 11, 2012, the entire subject matter of which is incorporated herein by reference.

BACKGROUND

1. Technical Field

An aspect of the present invention relates to a sheet conveyer and an image forming apparatus.

2. Related Art

A sheet conveyer with a sheet cassette for storing sheets therein, is known. The sheet cassette may include a lifting plate, on which the sheets to be conveyed are stacked. The lifting plate may be movable between a separated position, in which the lifting plate is lowered to be separated from a conveyer device, and an approximate position, in which the lifting plate is uplifted to be closer to the conveyer device.

The sheet conveyer may further have a lateral guides, which are slidably movable along a direction of width of the sheets, on the lifting plate. The lateral guides may fix a widthwise position of the sheets on the lifting plate and may be movable along with the lifting plate between the separated position and the approximate position.

When the lifting plate is placed in the approximate position, the sheets set on the lifting plate may contact the conveyer device so that the conveyer device may convey the contacting sheet.

If the lateral guides were not movable along with the lifting plate, for example, it might be necessary that the lateral guides might be attached to a bottom of the sheet cassette which is in a position lower than the lifting plate, and the lifting plate might be formed to have cutouts or other additional structure to avoid interference with the lateral guides when the lifting plate is moved. Thus, the sheet cassette might be required to have a more complicated structure, and a quantity of parts in the sheet cassette might be increased.

In the aforementioned sheet cassette, however, with the lateral guides which are movable integrally with the lifting plate, it is not necessary to form the cutouts in the lifting plate or to arrange other additional structure in the bottom of the sheet cassette. Accordingly, manufacturing cost for the sheet cassette may be lowered compared to the sheet cassette without the lateral guides movable along with the lifting plate.

SUMMARY

In the sheet conveyer with the lateral guides movable along with the lifting plate, however, when the lifting plate is uplifted to the approximate position, the lateral guides are also uplifted, and the lateral guides may interfere with other parts in the sheet conveyer. In order to avoid the interference, it is necessary that the lateral guides are set to be vertically separated from the other parts when the lifting plate is in the approximate position. Therefore, height of the sheet conveyer may not be reduced effectively.

In view of such consideration, the present invention is advantageous in providing a sheet conveyer and an image forming apparatus, of which manufacturing cost can be lowered, and of which height can be reduced effectively.

According to an aspect of the present invention, a sheet conveyer is provided. The sheet conveyer includes a body including a conveyer path formed therein; a conveyer arranged in an upstream position in the conveyer path along a direction of sheet conveyance in the body and configured to convey the sheet into the conveyer path; a conveyer-supporting frame configured to support the conveyer in the body; a first placement unit arranged in the body and including a lifting plate, the lifting plate being movable between a separated position, in which the lifting plate is separated downwardly from the conveyer, and an approximate position, in which the lifting plate is uplifted to be closer to the conveyer, the sheet to be conveyed into the conveyer path being placed on the lifting plate; and a lateral guide arranged on the lifting plate slidably along a widthwise direction of the sheet placed on the lifting plate and configured to restrict a widthwise position of the sheet placed on the lifting plate, the lateral guide being movable integrally with the lifting plate between the separated position and the approximate position. The conveyer is configured to contact the sheet placed on the first placement unit, when the lifting plate is in the approximate position, and convey the contacting sheet into the conveyer path. The conveyer-supporting frame is formed to have an interference-avoidable dented section, in which the side guide on the lifting plate placed in the approximate position is allowed to enter partly to avoid interference with the conveyer-supporting frame.

According to another aspect of the present invention, an image forming apparatus is provided. The image forming apparatus includes a body including a conveyer path formed therein; an image forming unit arranged along the conveyer path and configured to form an image on a sheet being conveyed in the conveyer path; a sheet conveyer. The sheet conveyer includes a conveyer arranged in an upstream position in the conveyer path along a direction of sheet conveyance in the body and configured to convey the sheet into the conveyer path; a conveyer-supporting frame configured to support the conveyer in the body; a first placement unit arranged in the body and including a lifting plate, the lifting plate being movable between a separated position, in which the lifting plate is separated downwardly from the conveyer, and an approximate position, in which the lifting plate is uplifted to be closer to the conveyer, the sheet to be conveyed into the conveyer path being placed on the lifting plate; and a lateral guide arranged on the lifting plate slidably along a widthwise direction of the sheet placed on the lifting plate and configured to restrict a widthwise position of the sheet placed on the lifting plate, the lateral guide being movable integrally with the lifting plate between the separated position and the approximate position. The conveyer is configured to contact the sheet placed on the first placement unit, when the lifting plate is in the approximate position, and convey the contacting sheet into the conveyer path. The conveyer-supporting frame is formed to have an interference-avoidable dented section, in which the side guide on the lifting plate placed in the approximate position is allowed to enter partly to avoid interference with the conveyer-supporting frame.

According to another aspect of the present invention, a sheet conveyer is provided. The sheet conveyer includes a body including a conveyer path formed therein; a conveyer arranged in an upstream position in the conveyer path along a direction of sheet conveyance in the body and configured to convey the sheet into the conveyer path; a conveyer-supporting frame configured to support the conveyer in the body; a first placement unit arranged in the body and including a lifting plate, the lifting plate being movable between a separated position, in which the lifting plate is separated downwardly from the conveyer, and an approximate position, in which the lifting plate is uplifted to be closer to the conveyer, the sheet to be conveyed into the conveyer path being placed on the lifting plate; and a lateral guide arranged on the lifting plate slidably along a widthwise direction of the sheet placed on the lifting plate and configured to restrict a widthwise position of the sheet placed on the lifting plate, the lateral guide being movable integrally with the lifting plate between the separated position and the approximate position. The conveyer is configured to contact the sheet placed on the first placement unit, when the lifting plate is in the approximate position, and convey the contacting sheet into the conveyer path. The conveyer-supporting frame and the lateral guide partially overlap each other horizontally along the widthwise direction when the lifting plate is in the approximate position.

BRIEF DESCRIPTION OF THE ACCOMPANYING DRAWINGS

DETAILED DESCRIPTION

Hereinafter, an embodiment of the present invention will be described with reference to the accompanying drawings.

Figure 1:
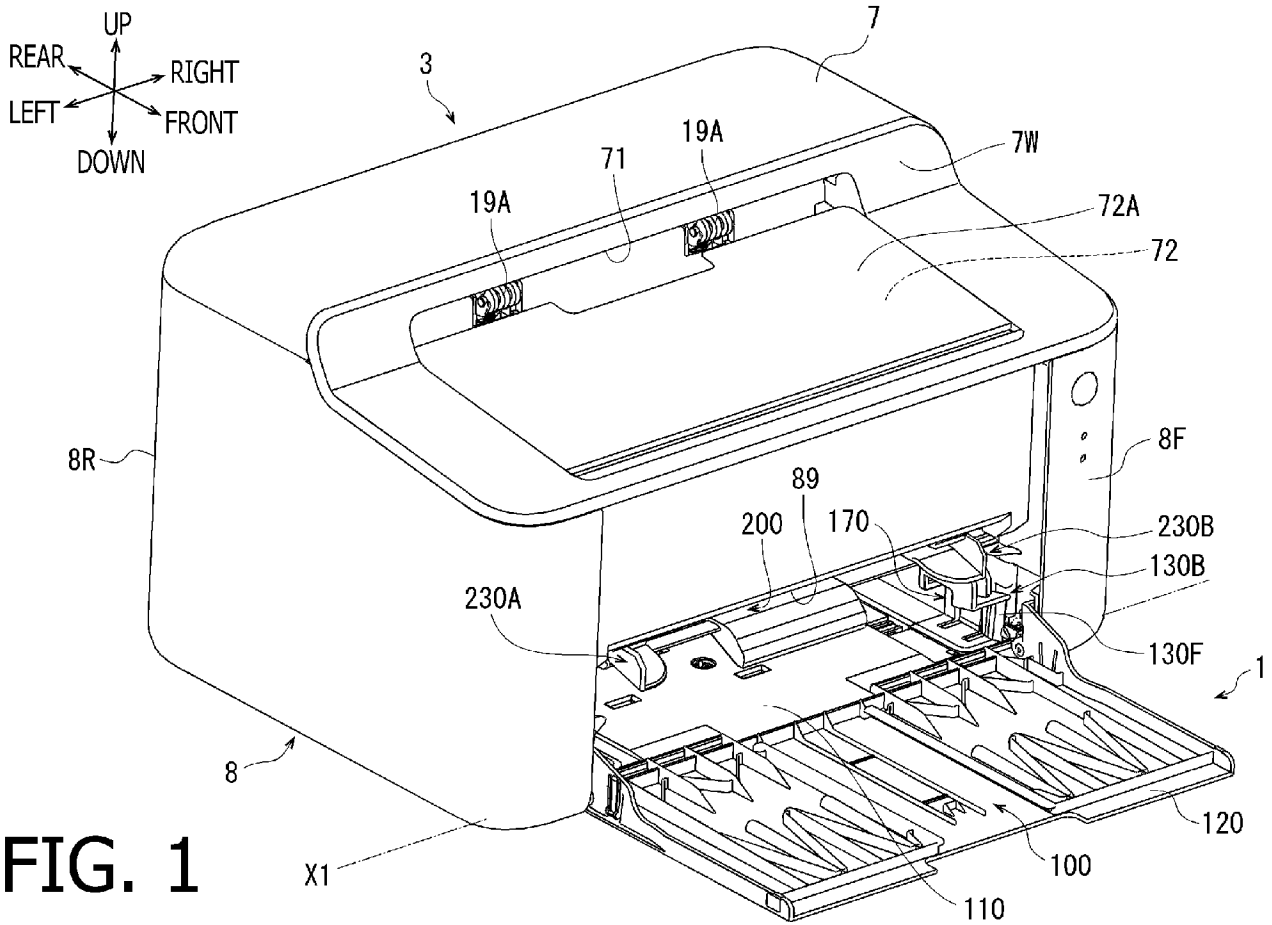
FIG. 1 is a perspective view of an image forming apparatus with a sheet conveyer according to an embodiment of the present invention.
Figure 2:
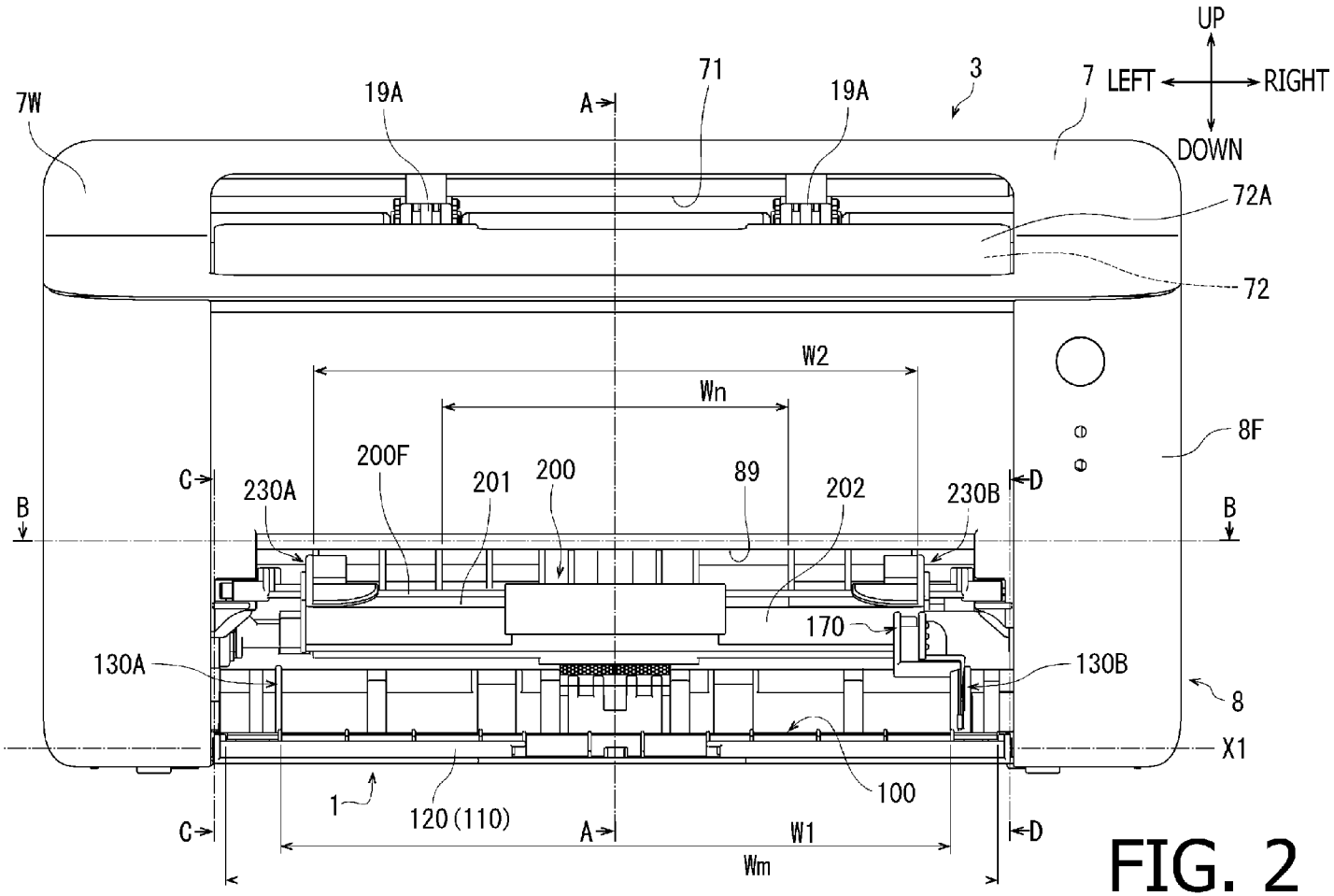
FIG. 2 is a front view of the image forming apparatus according to the embodiment of the present invention.
Figure 3:
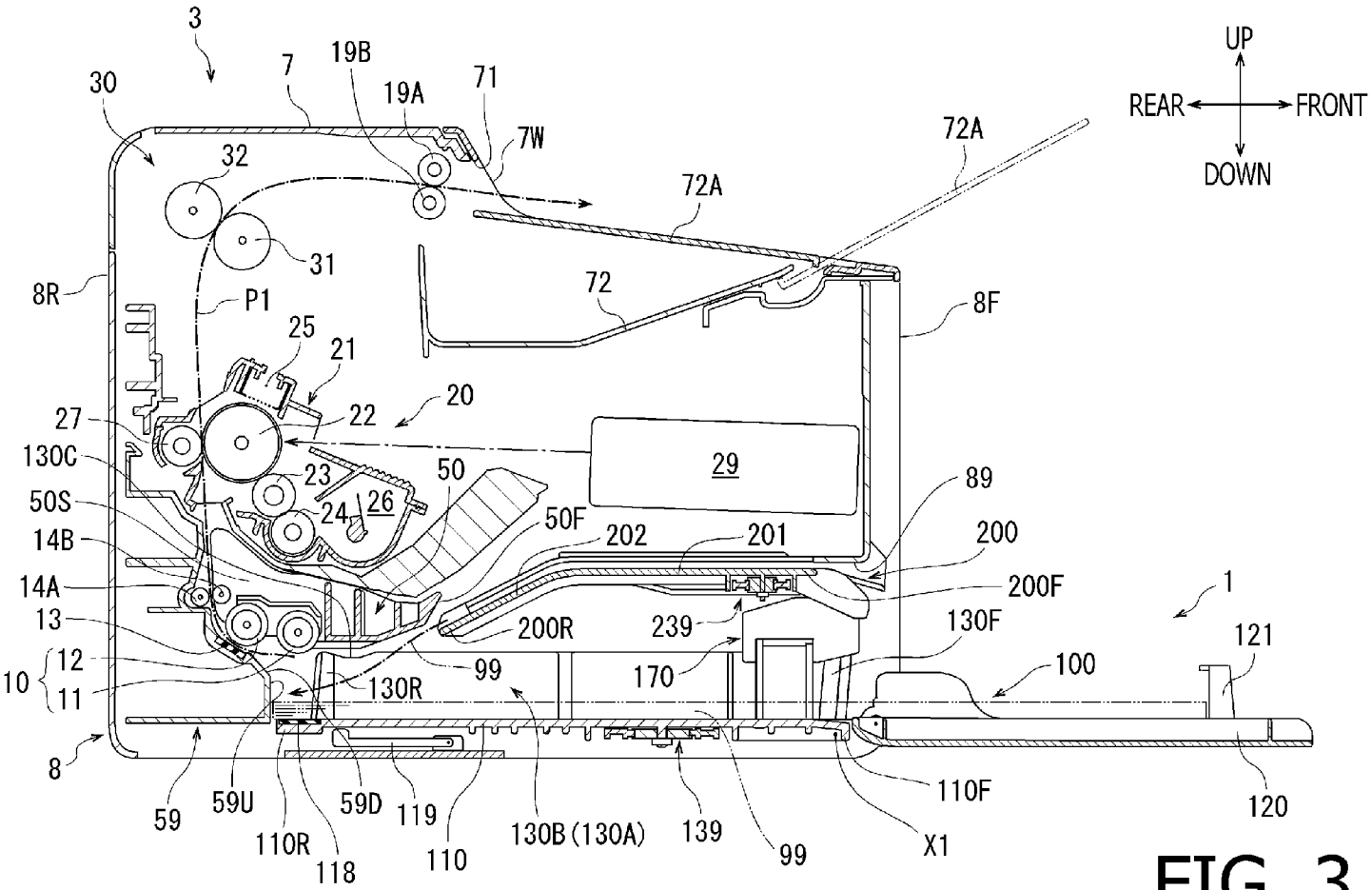
FIG. 3 is a cross-sectional side view of the image forming apparatus according to the embodiment of the present invention taken along a line A-A shown in FIG. 2.
Figure 4:
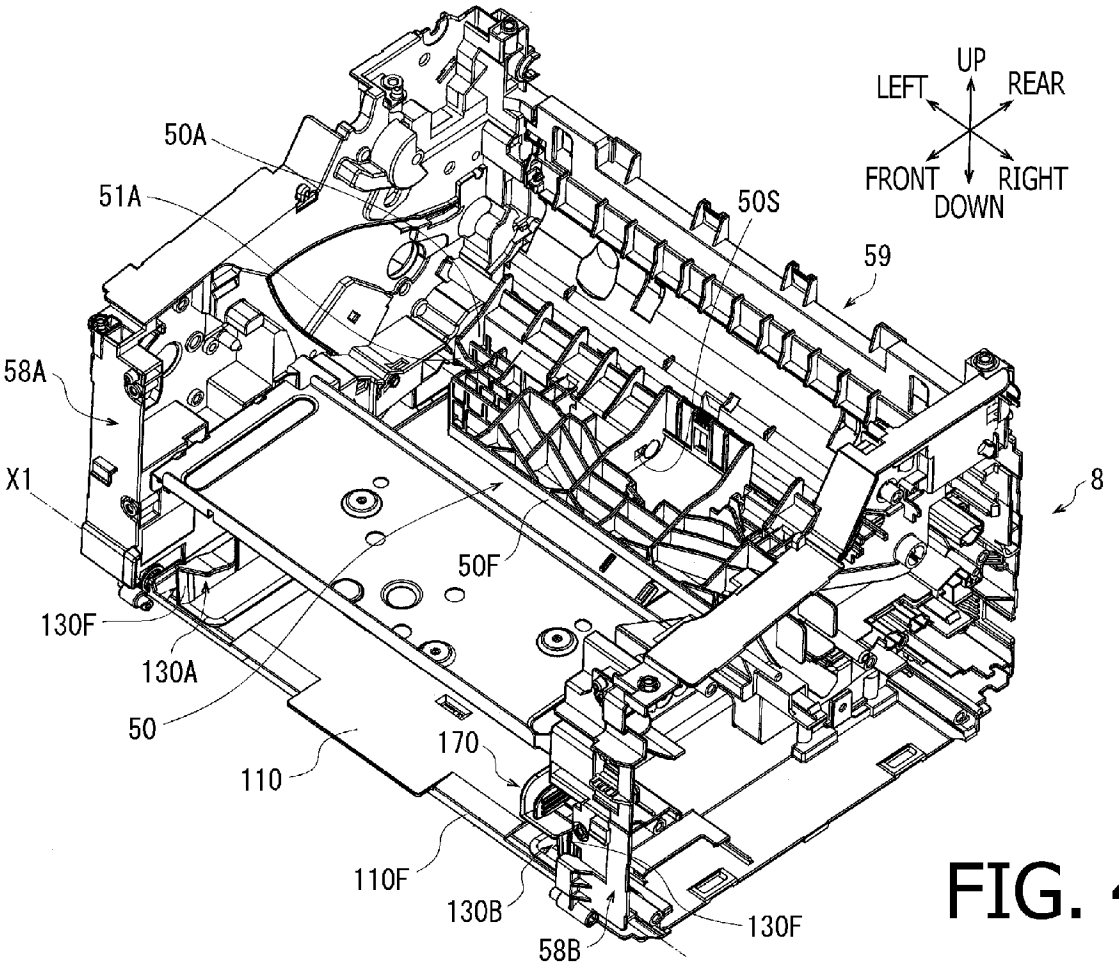
FIG. 4 is a perspective view of an internal assembly in the image forming apparatus, including lateral frames, a conveyer-supporting frame, and a lifting plate, according to the embodiment of the present invention.

As shown in FIGS. 1-3, an image forming apparatus 3 employs a sheet conveyer 1 according to the embodiment of the present invention. In the present embodiment, a nearer right-hand side appearing in FIG. 1, on which an opening 89 is formed, is referred to as a front side of the image forming apparatus 3. Then, directions concerning the image forming apparatus 3 will be referred to based on a user's position to ordinarily use the image forming apparatus 3 and in accordance with orientation indicated by arrows shown in FIG. 1. That is, for example, the user's left-hand side, when the user faces the front side with the opening 89 of the image forming apparatus 3, is referred to as a left-side face of the image forming apparatus 3. Further, a front-and-rear direction (depth), a right-and-left (widthwise) direction, and an up-and-down (vertical) direction are defined based on the user's view point. The orientation of the image forming apparatus 3 is also indicated by arrows shown in each drawing.

Overall Configuration of the Image Forming Apparatus

An overall configuration of the image forming apparatus 3 will be described hereinbelow. The image forming apparatus 3 in the present embodiment is a monochrome laser printer. As shown in FIG. 3, the image forming apparatus 3 includes a body 8, a conveyer 10, a separator pad 13, paired conveyer rollers 14A, 14B, a conveyer-supporting frame 50, a first placement unit 100, a pair of first lateral guides 130A, 130B, a second placement section 200, second lateral guides 230A, 230B, an image forming unit 20, and paired ejection rollers 19A, 19B. Among the components mentioned above, the body 8, the conveyer 10, the separator pad 13, the paired conveyer rollers 14A, 14B, the conveyer-supporting frame 50, the first placement unit 100, the first lateral guides 130A, 130B, the second placement section 200, the second lateral guides 230A, 230B, and the paired ejection rollers 19A, 19B constitute the sheet conveyer 1.

The body 8 is a chassis having a shape of a tiered box, which is higher at a side adjacent to a rear-side wall 8R with respect to a side adjacent to a front-side wall 8F. As shown in FIGS. 3-6, inside the body 8, frame components including a pair of right and left lateral frames 58A, 58B, a conveyer chute 59, and the conveyer-supporting frame 50 are arranged.

As shown in FIGS. 1-3, in a lower position on the front-side wall 8F of the body 8, the opening 89 is formed. Through the opening 89, an internal space in the body 8 and external atmosphere communicates with each other. An upper part of the body 8 is covered with an upper cover 7, which forms an upper outer plane of the body 8. The upper cover 7 is formed to have a cross-sectional shape of a crank, when viewed from a lateral position, along the tiered shape of the body 8.

The upper cover 7 is formed to have an ejection tray 72, on an upper side and on the side adjacent to the front-side wall 8F of the body 8. Further, an extension tray 72A is arranged on the upper cover 7. The extension tray 72A is supported by the upper cover 7 to be movable between an extended position, in which the extension tray 72A extends frontward with respect to the ejection tray 72, and a covering position, in which the extension tray 72A covers the ejection tray 72 from above. The extended position of the extension tray 72A is indicated by a double-dotted line in FIG. 3, and the covering position is indicated by a solid line in FIG. 3.

As shown in FIGS. 1-3, the upper cover 7 is curved upwardly at a rear end of the ejection tray 72 to form a slope wall 7W. In the slope wall 7W, an ejection opening 71, through which the internal space and the external atmosphere communicate each other, is formed.

The lateral frames 58A, 58B are mold-formed resin frames and, as shown in FIGS. 3-6, are arranged along the lateral faces of the body 8 to extend vertically and along the front-rear direction of the body 8.

The conveyer chute 59 is a mold-formed resin piece, which is arranged along the rear-side wall 8R of the body 8 to extend along the widthwise direction and the front-rear direction. A left-side edge of the conveyer chute 59 is connected to the lateral frame 58A on the left-hand side, and a right-side edge of the conveyer chute 59 is connected to the lateral frame 58B on the right-hand side.

The conveyer chute 59 is formed to have a vertical plane 59U, which rises vertically from a bottom of the body 8, and an inclined plane 59D, which inclines upper-rearward from an upper end of the vertical plane 59U toward the rear-side wall 8R.

The conveyer-supporting frame 50 is a mold-formed resin frame extending longitudinally along the widthwise direction in the body 8 (see FIGS. 3, 4, 6, and 7). The conveyer-supporting frame 50 is arranged in an upper front position with respect to the inclined plane 59D of the conveyer chute 89 in the body 8.

A left-side edge 50A of the conveyer-supporting frame 50 at a rear side is connected to the lateral frame 58A on the left-hand side, and a right-side edge 50B of the conveyer-supporting frame 50 at the rear side is connected to the side frame 58B on the right-hand side.

Figure 6:
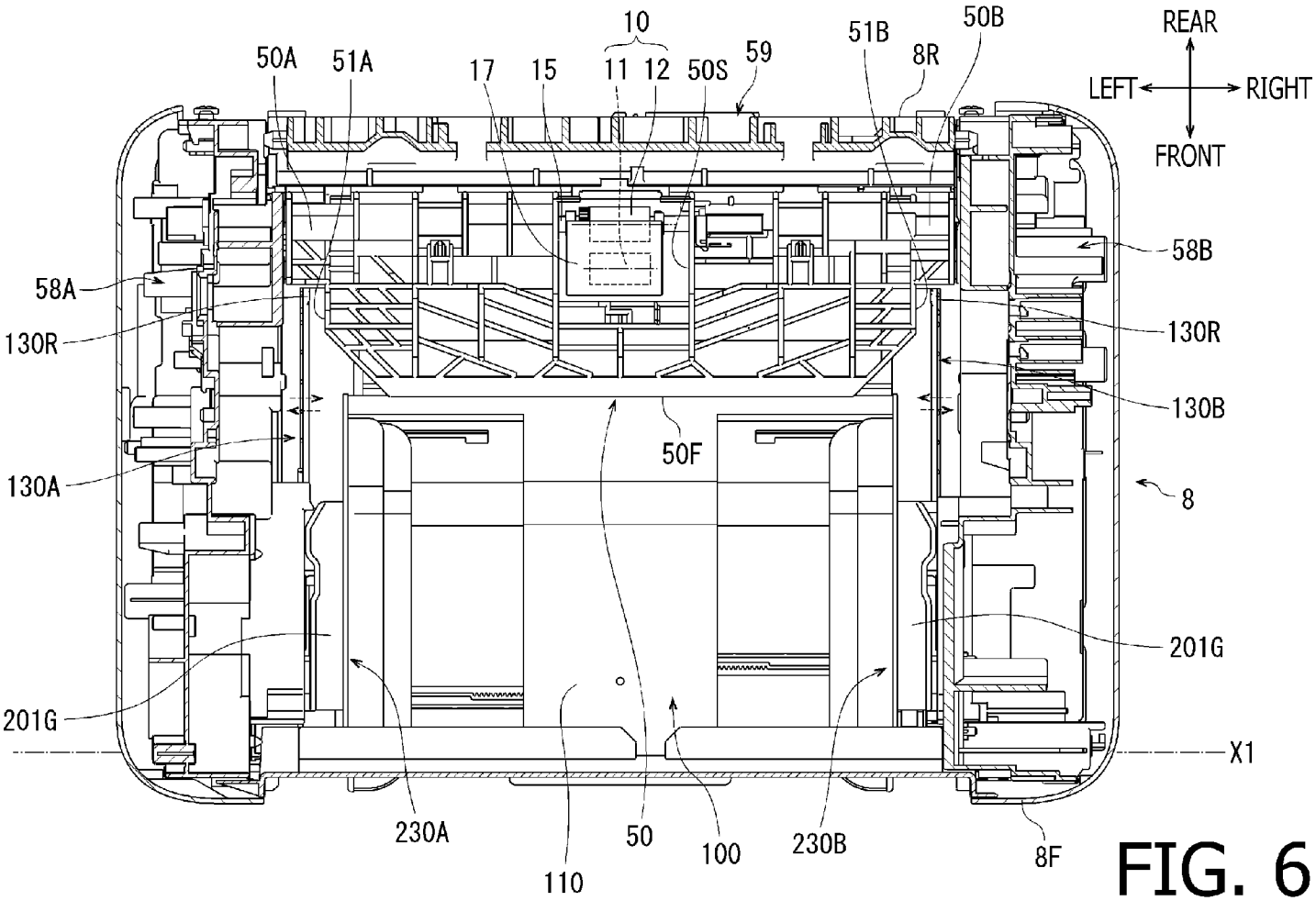
FIG. 6 is a cross-sectional view of the image forming apparatus according to the embodiment of the present invention taken along a line B-B shown in FIG. 2.
Figure 7:
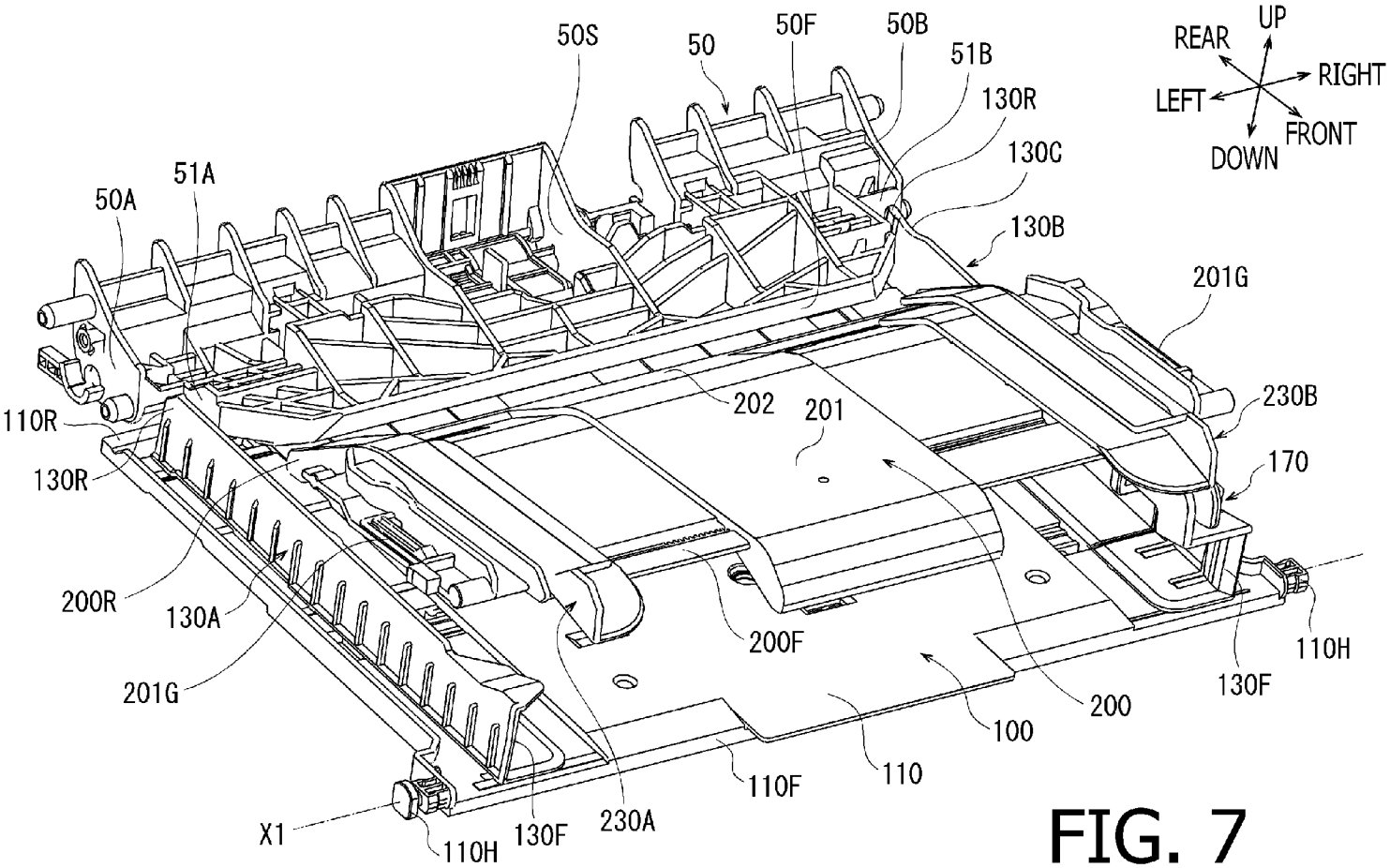
FIG. 7 is a perspective view of the conveyer-supporting frame, the lifting plate, the lateral guides, and a second placement unit in the image forming apparatus according to the embodiment of the present invention.

As shown in FIGS. 6 and 7, the conveyer-supporting frame 50 is formed to have an inward corner 51A in a frontward position with respect to the left-side edge 50A and an inward corner 51B in a frontward position with respect to the right-side edge 50B. The inward corner 51A is formed to have a corner dented rearward with respect to a front face 50F and rightward with respect to the left-side edge 50A of the conveyer-supporting frame 50. The inward corner 51B is formed to have a corner dented rearward with respect to the front face 50F and leftward with respect to the right-side edge 50B of the conveyer-supporting frame 50. Therefore, clearance is formed in lateral positions between a front portion of the conveyer-supporting frame 50 and the first lateral guide 130A and between the front portion of the conveyer-supporting frame 50 and the first lateral guide 130B. With the inward corners 51A, 51B, the conveyer-supporting frame 50 can avoid interference with the first lateral guides 130A, 130B when a lifting plate 110, which will be described later in detail, is in an approximate position.

As shown in FIG. 3, the body 8 includes a conveyer path P1, along which a sheet 99 is conveyed. The conveyer path P1 is formed to extend from an upper edge of the vertical plane 59U of the conveyer chute 59 along the inclined plane 59D toward the rear-side wall 8R of the body and curved upward to extend vertically. Further, the conveyer path P1 is turned frontward at a position below the upper cover 7 to reach the ejection opening 71 and ends at the ejection tray 72. As the sheet 99 is conveyed along the conveyer path P1, the starting point of the conveyer path P1 at the upper edge of the vertical plane 59U is a most upstream position in the conveyer path P1 along a direction of a flow of sheet conveyance, and the ending point at the ejection tray 72 is a most downstream position in the conveyer path P1 along the sheet conveying direction.

The conveyer 10 includes a feeder roller 11 and a separator roller 12, which are held by the conveyer-supporting frame 50 in neighboring positions from the rear-side wall 8R.

More specifically, as shown in FIGS. 4 and 6-8, the conveyer-supporting frame 50 is formed to have a conveyer-housing space 50S, which is dented in a rectangular box shape, at a widthwise center on a rear side closer to the rear-side wall 8A. The feeder roller 11 and the separator roller 12 are accommodated in the conveyer-housing space 50S.

Figure 8:
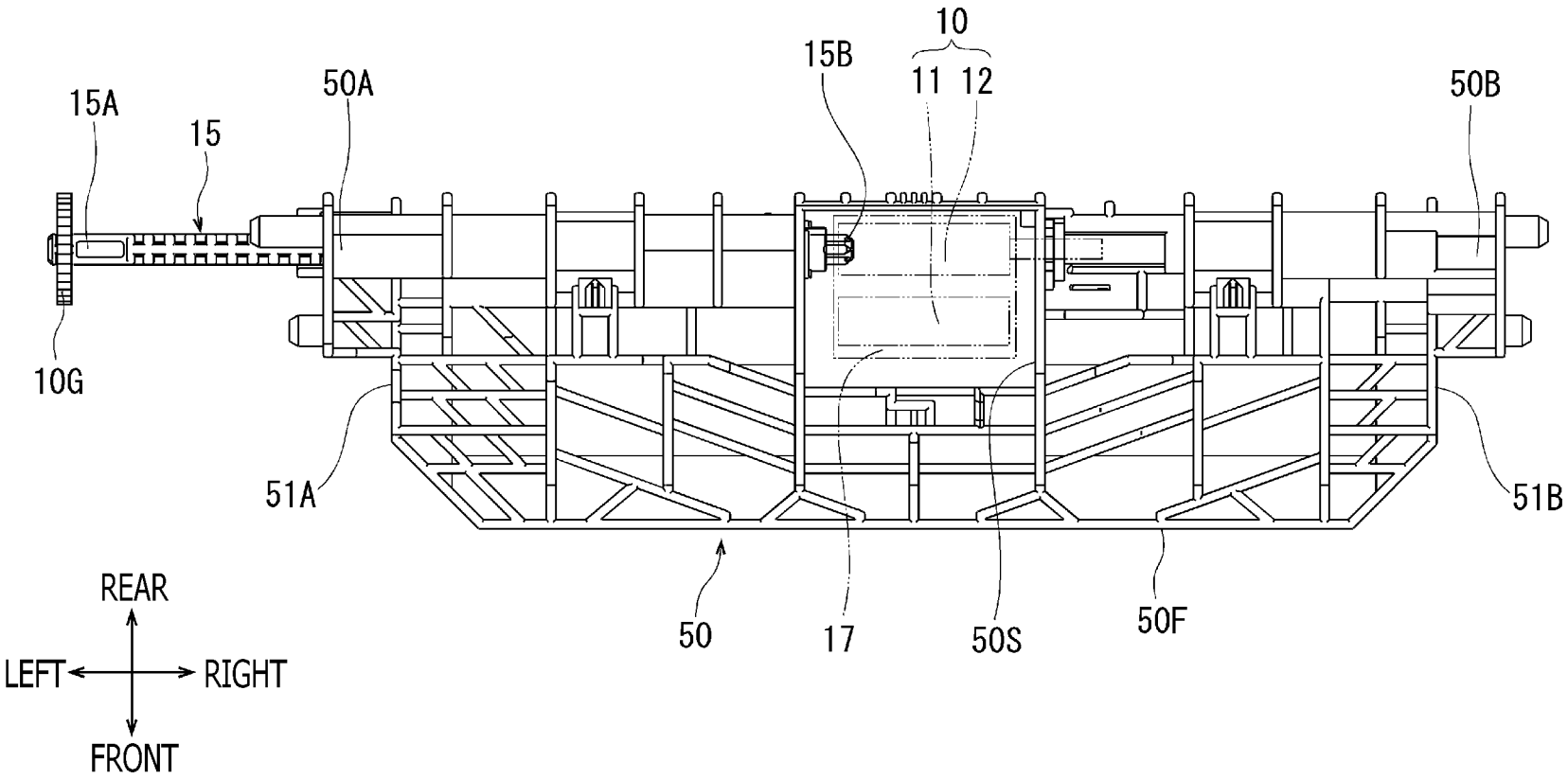
FIG. 8 is a top plane view of the conveyer-supporting frame and a conveyer in the image forming apparatus according to the embodiment of the present invention.

A shown in FIG. 8, the conveyer-supporting frame 50 rotatably supports a roller shaft 15. The roller shaft 15 connects a driving gear 10G, which is arranged beyond the left-side edge 50A of the conveyer-supporting frame 50, with the separator roller 12.

In particular, a right-side end 15B of the roller shaft 15 protrudes for a predetermined amount in the conveyer-housing space 50S along the widthwise direction, and the right-side end 15B of the roller shaft 15 is engaged with the separator roller 12. Inside the conveyer-housing space 50S, a holder 17, which is swingable coaxially with the roller shaft 15, is disposed. The holder 17 encloses the separator roller 12 laterally and stretches frontward to rotatably hold the feeder roller 11. Inside the holder 17, a transmission gear (not shown) to transmit rotation of the separator roller 12 to the feeder roller 11 is disposed.

Meanwhile, a left-side end 15A of the roller shaft 15 extends outwardly beyond the left-side edge 50A of the conveyer-supporting frame 50, and a driving gear 10G is fixed to the left-side end 15A. The driving gear 10G is driven by driving force from a driving source (not shown) provided in the body 8 and transmits rotating force to the separator roller 12 via the roller shaft 15.

As shown in FIG. 3, the separator roller 12 is arranged in a frontward position with respect to the conveyer chute 59 to face the inclined plane 59D. The feeder roller 11 is arranged in a frontward position with respect to the conveyer chute 59 and the separator roller 12 and in an upper position with respect to a rear end 110R of the lifting plate 110, which will be described later in detail. Thus, the feeder roller 11 and the separator roller 12 are disposed in the most upstream positions along the flow of sheet conveyance in the conveyer path P1.

The separator pad 13 is arranged on the inclined plane 59D in an opposite position from the separator roller 12 across the conveyer path P1. The separator pad 13 is urged against the separator roller 12.

The paired conveyer rollers 14A, 14B are arranged in upper positions with respect to the separator roller 12 and the separator pad 13 to face each other across the conveyer path P1.

In the image forming apparatus 3 of the present embodiment, due to presence of the first lateral guides 130A, 130B, it is not necessary to have a registration roller in a position along the conveyer path P1 between the paired conveyer rollers 14A, 14B and the image forming unit 20. The registration roller is a roller, which adjusts an orientation of a leading edge of the sheet 99 being conveyed to align the sheet 99 in a correct orientation with respect to the conveyer path P1. Since the first lateral guides 130A, 130B correct the orientation of the sheets 99 being conveyed, therefore, the registration roller may be omitted. Without the registration roller, a quantity of parts in the image forming apparatus 3 can be reduced, and manufacturing cost for the image forming apparatus 3 may be lowered.

The first placement unit 100 is provided in a bottom part of the body 8. The first placement unit 100 includes an openable/closable tray 120 and the lifting plate 100.

The openable/closable tray 120 includes a piece of flat plate, which is swingable about a lower end of the front-side wall 8F of the body 8. When the openable/closable tray 120 is in an open position to lie frontward and horizontally, the opening 89 is exposed (see FIG. 3). When the openable/closable tray 120 is in a closed position to rise vertically, the opening 89 is covered.

The lifting plate 110 includes a flat plate extending from the front-side wall 8F side toward the rear-side wall 8R side at the bottom part of the body 8. On an upper surface of the lifting plate 110 and on an upward-facing surface of the openable/closable tray 120, which faces upward when the openable/closable tray 120 is in the open position, one or more sheets 99 to be conveyed can be placed.

Figure 5:
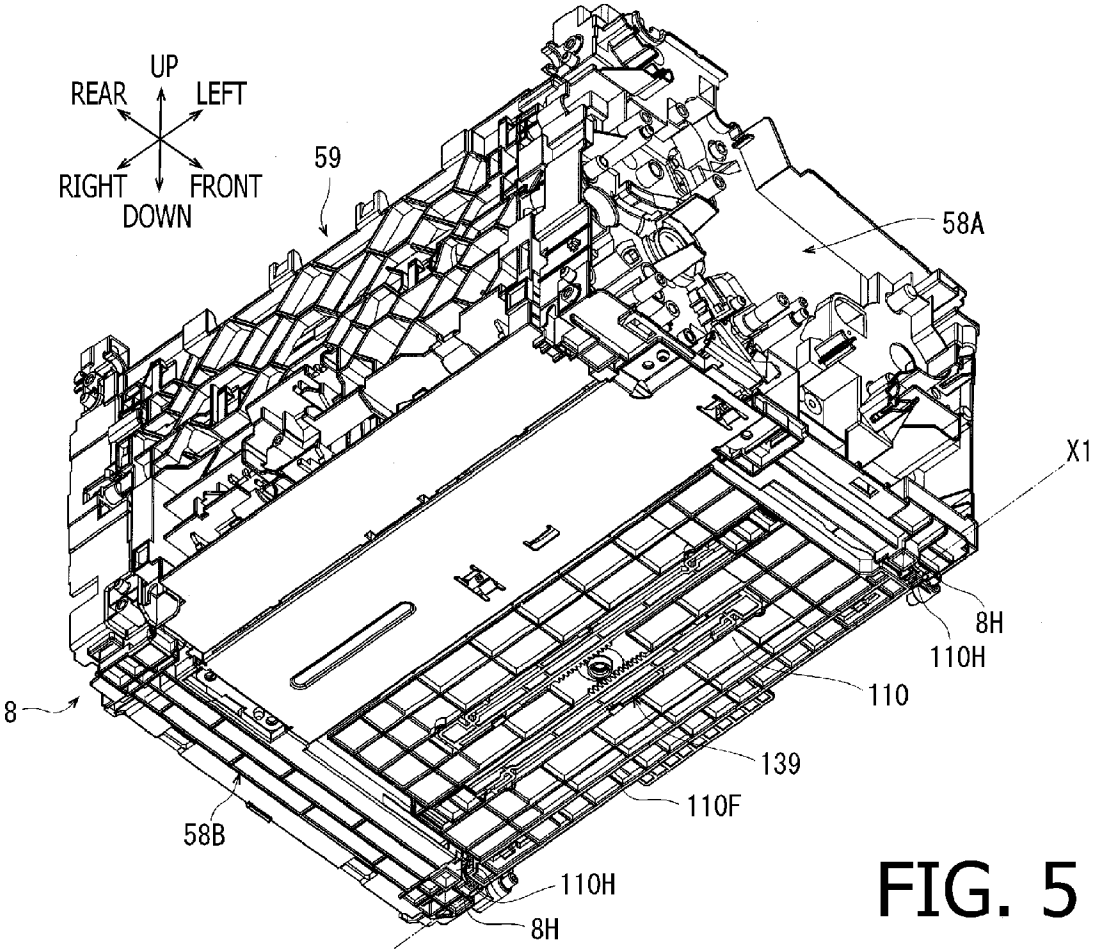
FIG. 5 is a perspective view of the internal assembly in the image forming apparatus, including the lateral frames, the lifting plate, a rack-and-pinion unit, according to the embodiment of the present invention.

As shown in FIG. 7, the lifting plate 110 is formed to have a pair of shafts 110H in a front-end part 110F closer to the front-side wall 8F of the body 8. Meanwhile, as shown in FIG. 5, the body 8 is formed to have a pair of shaft supports 8H, which are bearings arranged to support the shafts 110H swingably. Thus, the front-end part 110F of the lifting plate 110 is supported by the shafts 110H and the shaft supports 8H to be swingable about a swing axis X1, which extends in parallel with the widthwise direction of the image forming apparatus 3.

As shown in FIG. 3, a rear-end part 110R of the lifting plate 110 closer to the rear-side wall 8R of the body 8 faces the vertical plane 59U of the conveyer chute 59 along the front-rear direction. As the lifting plate 110 swings about the swing axis X1, the rear-end part 110R of the lifting plate 110 moves upwardly or downwardly in a lower position with respect to the feeder roller 11.

In the rear-end part 110R of the lifting plate 100, a frictional piece 118 is attached. The frictional piece 118 is a thin piece of frictional material with higher friction coefficient. The frictional piece 118 is arranged in a position to face the feeder roller 11 when the lifting plate 110 with no sheet 99 stacked thereon is placed in the approximate position.

In a lower position with respect to the lifting plate 110, a shift unit 119 is disposed. The shift unit 119 is arranged to initially extend horizontally along the front-rear direction. When an image is formed in the image forming apparatus 3, the shift unit 119 is pivoted by a controller (not shown) to swing and place the lifting plate 110 in the approximate position in an inclined posture with the rear-end part 110 to be tilted higher (see FIG. 9). When the image forming is completed, the shift unit 119 returns to the initial position shown in FIG. 3.

Therefore, when the image is formed on the sheets 99 which are placed on the first placement unit 100, the shift unit 119 pivots to place the lifting plate 110 in the approximate position, and a topmost sheet 99 of the sheets 99 stacked on the lifting plate 110 becomes in contact with the feeder roller 11. When the feed roller 11 in contact with the topmost sheet 99 is rotated by the controller, the topmost sheet 99 is moved rearward and fed in the conveyer path P1 by the feed roller 11.

As shown in FIGS. 3, 6, and 7, the first lateral guides 103A, 130B are arranged on the lifting plate 110 and slidable along the widthwise direction. The first lateral guides 130A, 130B face each other along the widthwise direction, rise vertically in shapes of partitions, and extend along the front-rear direction.

A front end 130F of each of the first lateral guides 130A, 130B closer to the front-side wall 8F of the body 8 is in a neighboring position from the swing axis X1 and the shaft support 8H, in particular, in a position approximately straight above the swing axis X1 and the shaft support 8H.

A rear end 130R of each of the first lateral guides 130A, 130B closer to the rear-side wall 8R of the body 8 is in a neighboring position from the feed roller 11, in particular, in a position approximately straight below the feeder roller 11. As shown in FIG. 3, the rear end 130R of the first lateral guide 130A, 130B is in a vertically overlapping position to coincide with the frictional piece 118, when viewed along the widthwise direction.

As shown in FIGS. 3 and 5, a rack-and-pinion unit 139 is arranged on a lower side of the lifting plate 110. The rack-and-pinion unit 139 is connected with the first lateral guides 130A, 130B. Therefore, the first lateral guides 130A, 130B are movable in association with each other to be closer to or separated from each other along the widthwise direction. With the behavior of the first lateral guides 130A, 130B, a widthwise position of the sheet 99 on the lifting plate 110 is restricted.

Further, on the upward-facing surface of the openable/closable tray 120, which faces upward when the openable/closable tray 120 is in the open position, an end guide 120, which is slidable along the front-rear direction, is arranged (see FIG. 3; not shown in FIG. 1). By the slidably movable end guide 121, a position of tail ends of the sheets 99 on the openable/closable tray 120 can be restricted.

As shown in FIGS. 1, 2, and 7, the first lateral guide 130B on the right is integrally formed to have a handle 170 to manipulate the first lateral guides 130A, 130B. The handle 170 is formed to extend from the upper edge and the front end 130F of the first guide 103B on the right inwardly toward a widthwise center of the image forming apparatus 3 to be closer to the first lateral guide 130A on the left and curved upwardly to extend vertically to be closer to the front-side wall 8F of the body 8. The handle 170, when viewed along the front-rear direction to face the front-side wall 8F of the body 8, i.e., as shown in FIG. 2, partially overlaps an inclined part 202 of a second placement unit 200 horizontally.

More specifically, as shown in FIG. 3, the handle 170 is arranged in a lower position with respect to a horizontal part 201 of the second placement unit 200, and a dimension of the handle 170 along the front-rear direction is smaller than a dimension of the horizontal part 201 of the second placement unit 200 along the front-rear direction. Therefore, when the first lateral guide 130B with the handle 170 is moved along the widthwise direction, interference of the handle 170 with the inclined part 202 of the second placement unit 200 is prevented.

When a user pinches the handle 170 and moves along the widthwise direction, the first lateral guide 130B on the right slidably moves integrally along with the handle 170. The slidable movement of the first lateral guide 130B on the right is transmitted to the first lateral guide 130A on the left via the rack-and-pinion unit 139 to move the first lateral guide 130A on the left to a direction opposite from the moving direction of the first lateral guide 130B on the right. Thus, the first lateral guides 130A, 130B are movable to be closer to or farther away from each other along the widthwise direction. As shown in FIG. 2, the first lateral guides 130A, 130B can restrict and fix the widthwise position of the sheet 99 on the lifting plate 110 within a range between a first width W1 and a maximum width Wm, which are allowable as a width of the sheet 99.

In the present embodiment, the first width W1 is a width of "A4" size (210 mm*297 mm), and the maximum width Wm is a width of letter size (216 mm*279 mm). Therefore, in the first placement unit 100, the positions of the first lateral guides 130A, 130B can be switched between positions for the A4 size and positions for the letter size. The first lateral guides 130A, 130B shown in FIG. 2 are in the positions for the first width W1, i.e., the A4-sized position. Meanwhile, the first lateral guides 130A, 130B shown in FIG. 7 are in the positions for the maximum width Wm, i.e., the letter-sized position.

Figure 9:
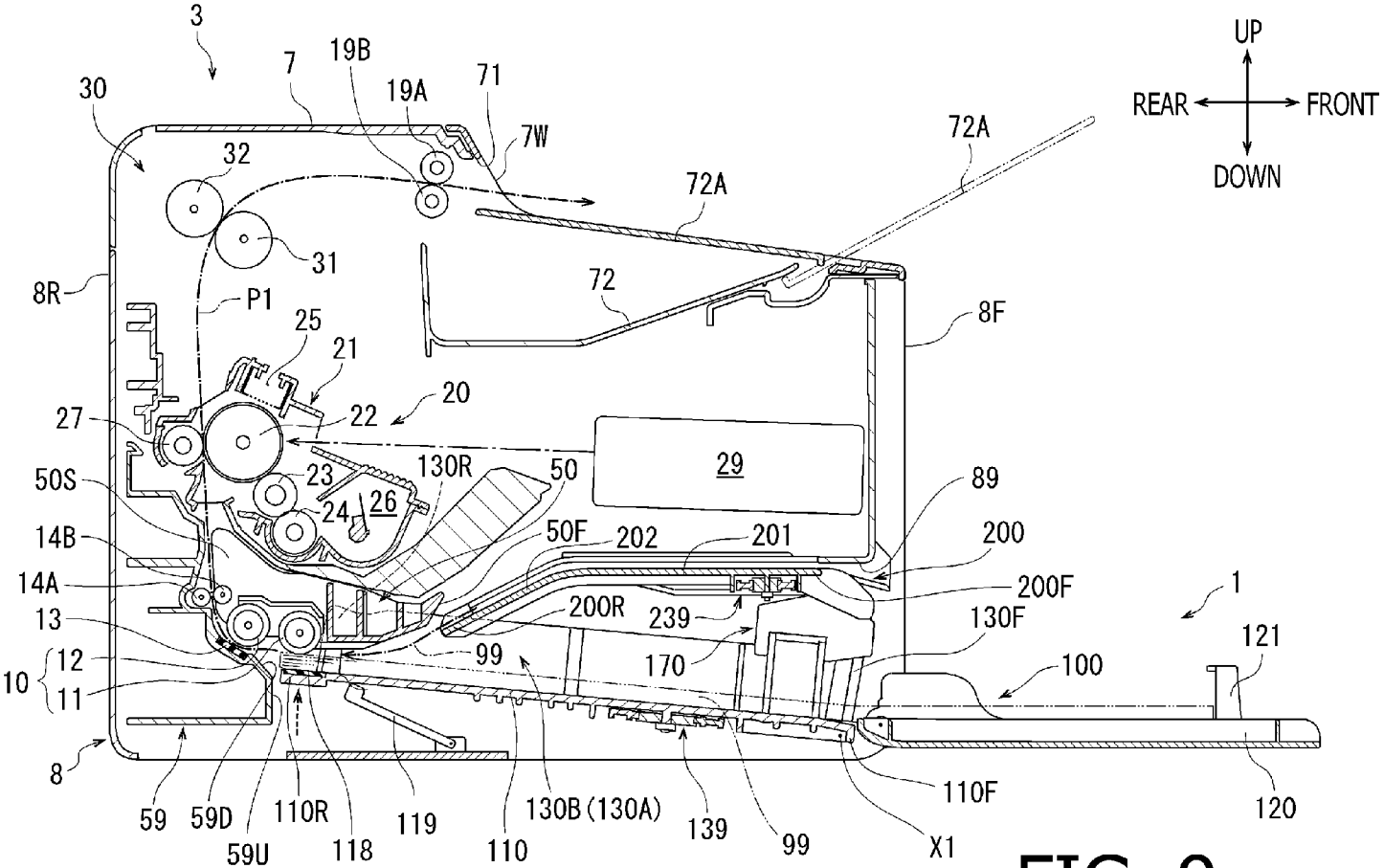
FIG. 9 is a cross-sectional side view of the image forming apparatus with a first placement unit and the second placement unit according to the embodiment of the present invention.

As shown in FIG. 3, when the shift unit 119 is not pivoted but lies flat, the lifting plate 110 is in a separated position to lie horizontally in a downwardly separated position with respect to the feeder roller 11. When the shift unit 119 is pivoted to the inclined posture to tilt the rear-end part 110R higher, as shown in FIG. 9, the lifting plate 110 is uplifted from the separated position to be closer to feed roller 11 to the approximate position. The approximate position of the lifting plate 110 may vary depending on a quantity of the sheets 99 placed on the lifting plate 99.

Figure 10:
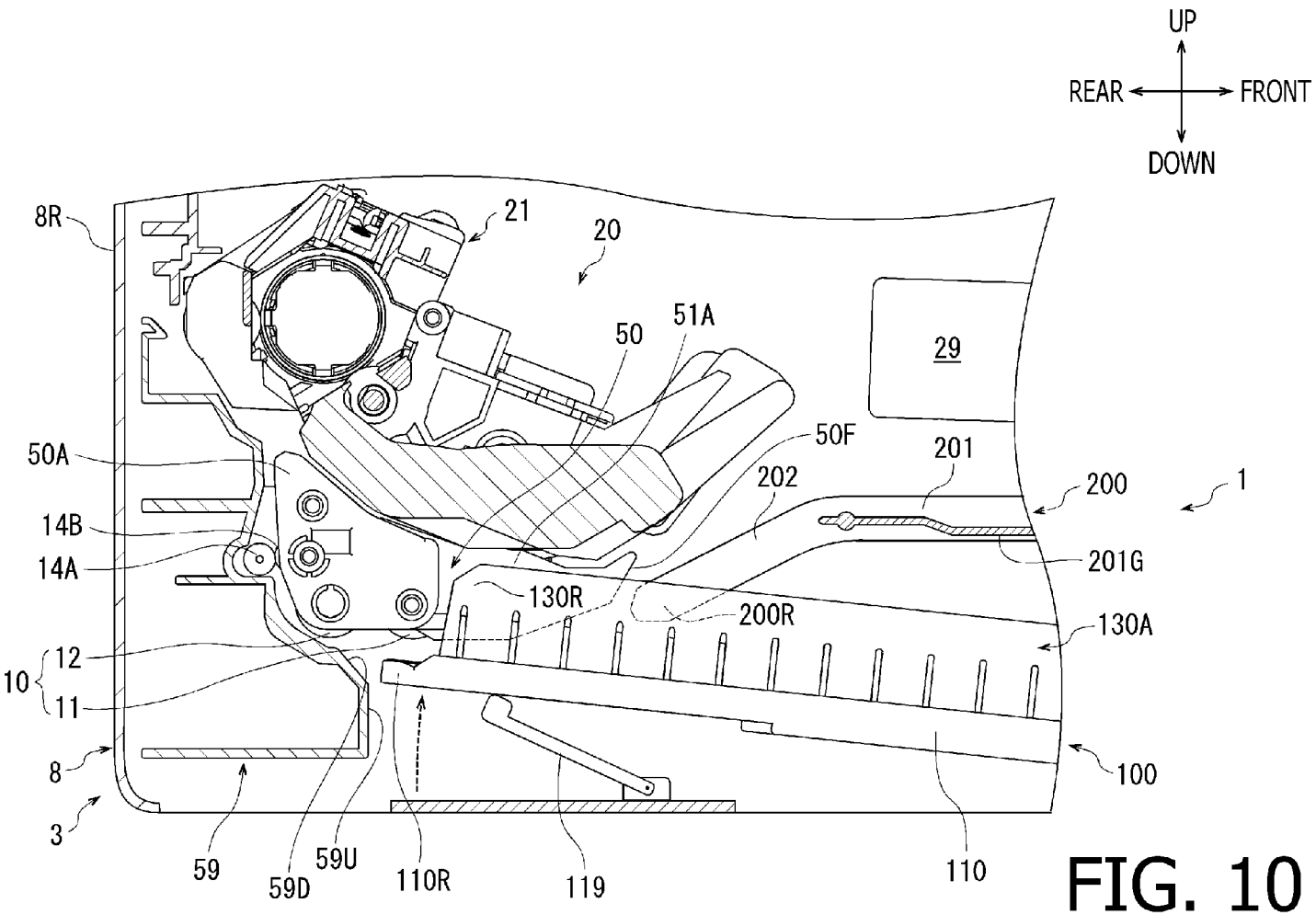
FIG. 10 is a cross-sectional view of the image forming apparatus according to the embodiment of the present invention taken along a line C-C shown in FIG. 2.
Figure 11:
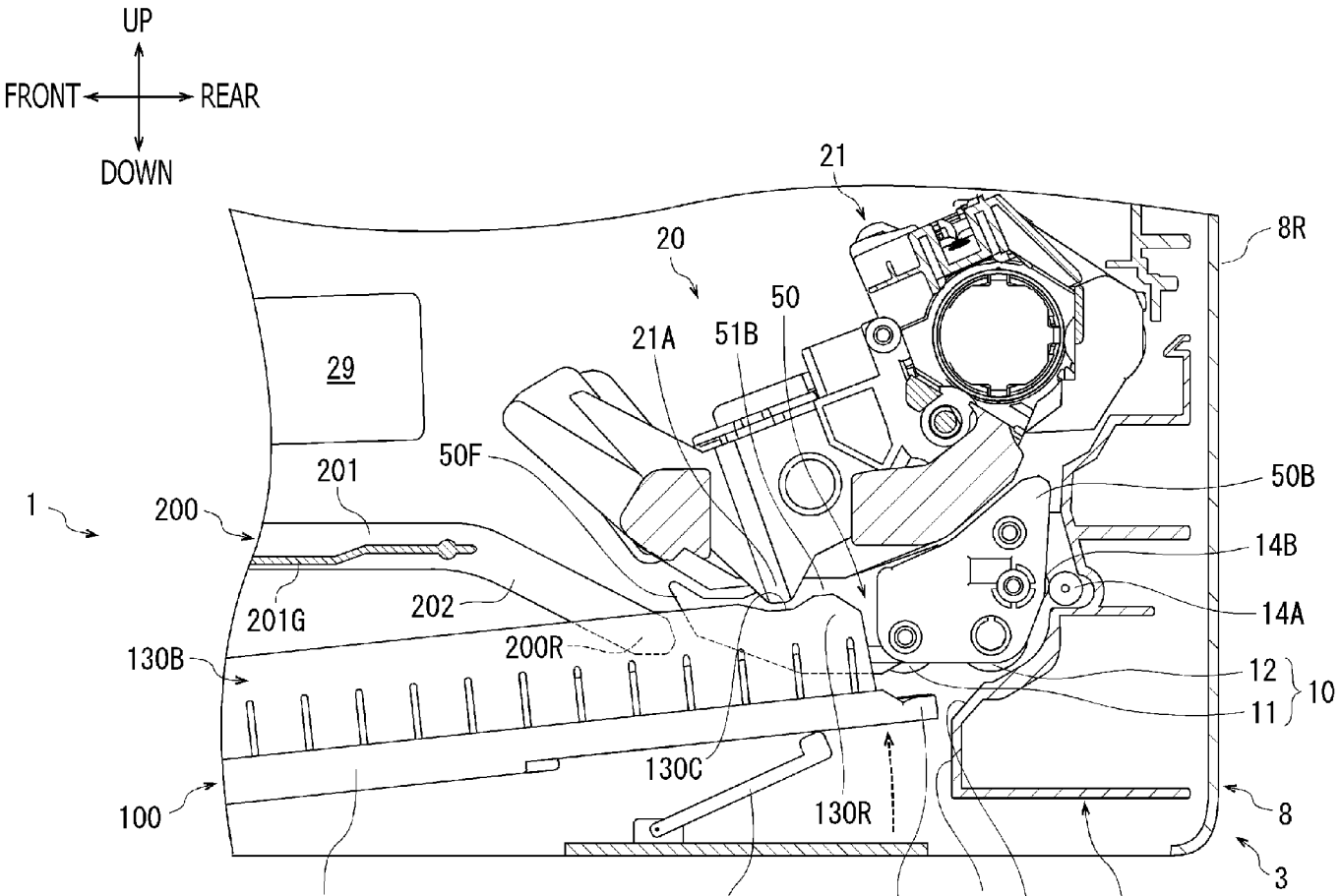
FIG. 11 is a cross-sectional view of the image forming apparatus according to the embodiment of the present invention taken along a line D-D shown in FIG. 2.

The first lateral guides 130A, 130B are movable along with the lifting plate 110 while the lifting plate 110 is moved between the separated position and the approximate position. When the lifting plate 110 is placed in the approximate position, as shown in FIGS. 7 and 10, the rear end 130R of the first lateral guide 130A on the left is enters the dented room formed by the inward corner 51A on the left of the conveyer-supporting frame 50. Similarly, at the same time, as shown in FIGS. 7 and 11, the rear end 130R of the first lateral guide 130B on the right enters the dented room formed by the inward corner 51B on the right of the conveyer-supporting frame 50.

In other words, when the lifting plate 110 is placed in the approximate position, the rear end 130R of the first lateral guide 130A on the left horizontally overlaps the conveyer-supporting frame 50 partially when viewed along the widthwise direction. At the same time, the rear end 130R of the first lateral guide 130B on the right horizontally overlaps the conveyer-supporting frame 50 partially when viewed along the widthwise direction. In this regard, collision between the first lateral guides 130A, 130B and the conveyer-supporting frame 50 is prevented.

Meanwhile, as shown in FIGS. 3 and 7, the second placement unit 200 is arranged in the body 8 in an upper position with respect to the first placement unit 100 and a lower position with respect to an upper edge of the opening 89. The second placement unit 200 can be used to manually feed sheets 99, which are smaller in width than the width of the sheets 99 to be placed on the lifting plate 110 of the first placement unit 100.

The second placement unit 200 is arranged in the body 8 to have a front end 200F being an end portion closer to the front-side wall 8F along the front-rear direction to be in a neighboring position with respect to the opening 89. Meanwhile, a rear edge 200R of the second placement unit 200 being an end portion closer to the rear-side wall 8R of the body 8 along the front-rear direction extends to a frontward position with respect to the conveyer-supporting frame 50. The front end 200F of the second placement unit 200 is in a higher position with respect to the rear edge 200R.

The second placement unit 200 includes the horizontal part 201 and the inclined part 202. The horizontal part 201 extends from the front end 200F rearward toward the rear-side wall 8R horizontally. The inclined part 202 extends from a rear end of the horizontal part 201 downwardly in an inclined posture to the rear end 200R.

As shown in FIG. 7, the second lateral guides 230A, 230B are arranged on the horizontal part 201 and slidably movable along the widthwise direction. The second lateral guides 230A, 230B face each other along the widthwise direction and extend along the front-rear direction.

As shown in FIG. 3, a rack-and-pinion unit 239 is arranged on a lower side of the horizontal part 201. The rack-and-pinion unit 239 is connected with the second lateral guides 230A, 230B. Therefore, the second lateral guides 230A, 230B are movable in association with each other to be closer to or separated from each other along the widthwise direction on the horizontal part 201. With the behavior of the second lateral guides 230A, 230B, a widthwise position of the sheet 99 to be placed on the second placement unit 200 is restricted and fixed.

As shown in FIG. 2, the second lateral guides 230A, 230B can restrict the widthwise position of the sheets 99 on the second placement unit 200 within a range between a minimum width Wn and a second width W2, which is smaller than the first width W1. Therefore, the second width W2 being the maximum available width provided by the second lateral guides 230A, 230B is smaller than the first width W1, which is the minimum available width provided by the first lateral guides 130A, 130B. Further, a width of the inclined part 202 is, as well as the second width W2 being smaller than the first width W1, smaller than the first width W1 being the minimum available width provided by the first lateral guides 130A, 130B. However, it is to be noted that a movable range for the second lateral guides 230A, 230B within the second width W2 along the widthwise direction (i.e., a difference between W2 and Wn) is larger than a movable range for the first lateral guides 130A, 130B within the first width W1 (i.e., a difference between Wm and W1). With the form of the inclined part 202 having the smaller width than the first width W1, the inclined part 202 is prevented from being interfered with by the first lateral guides 130A, 130B when the lifting plate 110 is in the approximate position.

Figure 12:
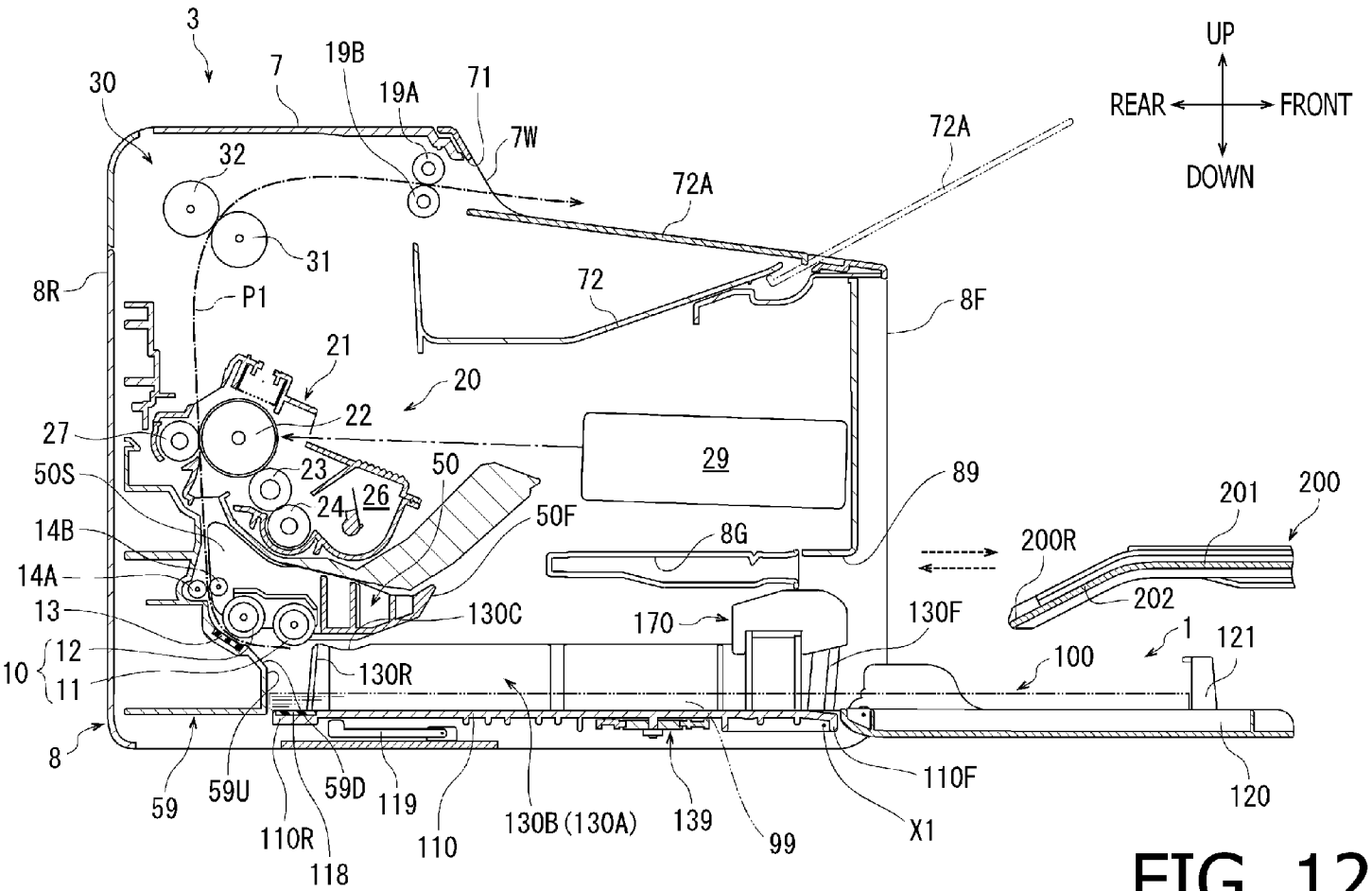
FIG. 12 is a cross-sectional side view of the image forming apparatus with the second placement unit being drawn out of a body of the image forming apparatus according to the embodiment of the present invention.

The second placement unit 200 is removable from the body 8 of the image forming apparatus 3 through the opening 89. As shown in FIG. 12, the body 8 has a pair of guiding members 8G, which extend horizontally from the opening 89 toward the rear-side wall 8R on right and left sides of the opening 89. More specifically, the guiding member 8G on the left is formed to protrude inwardly (i.e., rightward) from an inner surface of the lateral frame 58A on the left, and the guiding member 8G on the right is formed to protrude inwardly (i.e., leftward) from an inner surface of the lateral frame 58B on the right. Further, as shown in FIG. 7, the second placement unit 200 is formed to have a pair of guided parts 201G on the horizontal part 201. Each guided part 201G is formed in a shape of a rib protruding outwardly from a widthwise end of the horizontal part 201.

The guiding members 8G are formed in positions to face the horizontal part 201 of the second placement unit 200. A rear end of each guiding member 8G extends along the front-rear direction to a position corresponding to the rear end of the horizontal part 201 of the second placement unit 200. In this regard, if the guiding members 8G are extended to positions corresponding to the rear end of the horizontal part 201 of the second placement unit 200, when the lifting plate 110 is placed in the approximate position, the first lateral guides 130A, 130B and the guiding members 8G interfere with each other. Therefore, with the guiding members 8G formed to end at the position corresponding to the rear end of the horizontal part 201 of the second placement unit 200, the interference of the first lateral guides 130A, 130B with the guiding members 8G can be prevented.

The second placement unit 200 can be inserted in the body 8 horizontally from the front toward the rear through the opening 89 with the guided parts 201G fitted in the guiding members 8G. As the guided parts 20G are guided in the guiding members 8G, the second placement unit 200 is installed in the body 8 (see FIG. 3). The second placement unit 200 can be drawn frontward horizontally out of the body 8 while the guided parts 201G are guided by the guiding members 8G. Thus, the second placement unit 200 is removed out of the body 8 through the opening 200 (see FIG. 7).

As shown in FIG. 3, while the shift unit 119 is not pivoted but lies flat, and when the lifting plate 110 is in the separated position, the sheets 99 can be fed manually through the second placement unit 200. When the sheets 99 are manually fed, leading ends of the sheets 99 are guided rearward along the horizontal part 201 and lower-rearward along the inclined part 202 to reach the lifting plate 110 or the topmost sheet 99 of the sheets stacked on the lifting plate 110. Further, the leading ends of the manually-fed sheets 99 slide on the lifting plate 110 or on top of the stacked sheets 99 to reach the vertical plane 59U of the conveyer chute 59 and stop thereat.

As shown in FIG. 9, when the shift unit 119 is pivoted to move the lifting plate 110 to the approximate position in order to form images on the sheets 99 placed on the second placement unit 200, the leading ends of the manually-fed sheets 99 are uplifted by the lifting plate 110 until a topmost sheet 99 contacts the feed roller 11. As the feed roller 11 is manipulated by the controller and rotates with the manually-fed topmost sheet 99 contacting the feed roller 11, the manually-fed sheets 99 are moved rearward to be conveyed into the conveyer path P1. The frictional piece 118 on the lifting plate 110 applies friction force to the topmost sheet 99 of the manually-fed sheets 99 so that solely the topmost sheet 99 is separated from the other manually-fed sheets 99 and fed in the conveyer path P1. Thus, multiple feed of the sheets 99 can be prevented.

As shown in FIG. 3, the image forming unit 20 includes a processing cartridge 20, a scanner unit 29, and a fixing unit 30.

The processing cartridge is arranged in an upper position with respect to the conveyer-supporting frame 50. The processing cartridge 21 is a box extending along the widthwise direction and allows a vertical section of the conveyer path P1 to vertically penetrate through. In the processing cartridge 21, a photosensitive drum 22, a transfer roller 27, a developer roller 23, a supplier roller 24, a toner container 26, and a charger 25 are arranged.

The photosensitive drum 22 has a cylindrical body extending along the widthwise direction and is arranged in a frontward position with respect to the vertical section of the conveyer path P1. The transfer roller 27 is arranged to face the photosensitive drum 22 across the conveyer path P1. The photosensitive drum 22 and the transfer roller 27 nip the sheet 99 being conveyed in the vertical section of the conveyer path and rotate synchronously. The toner container 26 contains toner to be supplied to the photosensitive drum 22. The supplier roller 23 supplies the toner from the toner container 26 to the developer roller 23. The developer roller 23 develops an electrostatic latent image formed on the photosensitive drum 22 to be a toner image. The charger 25 is arranged in a separated upper position with respect to the photosensitive drum 22 and extends along the widthwise direction in parallel with the photosensitive drum 22. The charger 25 discharges corona to positively charge the photosensitive drum 22.

When forming an image, it is necessary that dimensions of some of the image forming components in the image forming unit 20, such as the photosensitive drum 22 and the developer roller 23, are greater than the width of the sheet 99 to have images formed thereon. Accordingly, a size of the processing cartridge 21 accommodating the image forming components tends to be increased, and the processing cartridge 21 is formed to have a jut 21A, which protrudes downward, in an upper position with respect to the first lateral guide 130B on the right (see FIG. 11).

Meanwhile, the first lateral guide 130B on the right is formed to have a cutout 130C, which dents downward from the upper edge, in a frontward position with respect to the rear end 130R of the first lateral guide 130B on the right (see FIGS. 3, 7, and 11). With the cutout 130C, collision between the first lateral guide 130B on the right and the image forming unit 20 is prevented when the lifting plate 110 is in the approximate position.

The scanner unit 29 is arranged in a frontward position with respect to the processing cartridge 21. The scanner unit 29 includes a laser light source, a polygon mirror, an fθ lens, and reflection mirrors, which are not shown. The scanner unit 29 emits a laser beam toward the photosensitive drum 22.

The fixing unit 30 is arranged in an upper position with respect to the photosensitive drum 22 and the transfer roller 27, which are arranged along the vertical section of the conveyer path P1. The fixing unit 30 includes a heat roller 31, which is arranged in a frontward position with respect to the conveyer path P1, and a pressure roller 32, which faces the heat roller 31 across the conveyer path P1.

The paired ejection rollers 19A, 19B are arranged in most downstream positions along the conveyer path P1, where the conveyer path P1 extends frontward, to face the ejection opening 71. The pared ejection rollers 19A, 19B face each other across the conveyer path P1.

Sequence in Image Forming

A sequence to form an image on the sheet 99 placed on the first placement unit 100 or the second placement unit 200 in the image forming apparatus 3 will be described hereinbelow. As the controller is activated, the shifting system 119 moves the lifting plate 110 from the separated position to the approximate position (see FIGS. 3 and 9). If no sheet 99 is set on the second placement unit 200, the sheet 99 set on the lifting plate 110 in the first placement unit 100 contacts the feed roller 11. If the sheet 99 is set on the second placement unit 200, the sheet 99 on the second placement unit 200 contacts the feed roller 11.

Thereafter, the feed roller 11, the separator roller 12, the paired conveyer rollers 14A, 14B, the image forming unit 20, and the paired ejection rollers 19A, 19B are driven. Accordingly, the sheet 99 being in contact with the feed roller 11 is fed in the conveyer path P1 to be conveyed. The sheet 99 being conveyed contacts a lower part of the inclined plane 59D and is guided upward along the inclined plane 59. The separator roller 12 separates the topmost sheet 99 from the other sheets 99. The paired conveyer rollers 14A, 14B convey the separated topmost sheet 99 toward the processing cartridge 21.

Meanwhile, in the processing cartridge 21, a circumference of the photosensitive drum 22 is positively charged by the charger 25 evenly and exposed to the laser beam selectively emitted from the scanner unit 29. Thereby, an electrostatic latent image, which corresponds to an image to be formed on the sheet 99, is formed on the circumference of the photosensitive drum 22. Thereafter, the developer roller 23 and the supplier roller 23 supply the toner from the container 26 to the electrostatic latent image formed on the circumference of the photosensitive drum 22. Thus, a toner image corresponding to the latent image is formed on the circumference of the photosensitive drum 22. The toner image is transferred onto the sheet 99, while the sheet 99 is in contact with the photosensitive drum 22 and the photosensitive drum 22 rotates, by an effect of negative voltage applied to the transfer roller 27.

The sheet 99 with the toner image transferred thereon is conveyed further upward along the conveyer path P1 to reach the fixing unit 30, where the heat roller 31 heats the sheet 99 and the pressure roller 32 urges the sheet 99 against the heat roller 31. Thus, the toner image is thermally fixed on the sheet 99. The sheet 99 with the fixed image is conveyed by the paired ejection rollers 19A, 19B and ejected toward the ejection tray 72 through the ejection opening 71. The sequence for forming the image in the image forming apparatus 3 ends thereat.

Effects

The sheet conveyer 1 in the present embodiment includes the first lateral guides 130A, 130B, which are movable integrally with the lifting plate 110. Therefore, it is not necessary to modify the bottom of the body 8 to attach the first lateral guides 130A, 130B or to form a cutout in the lifting plate 110. Thus, the structure in the sheet conveyer 1 can be less complicated, and a quantity of parts in the sheet conveyer 1 can be reduced.

According to the sheet conveyer 1 in the present embodiment, the conveyer-supporting frame 50 is formed to have the inward corners 51A, 51B. Therefore, when the lifting plate 110 is moved to the approximate position, the first lateral guides 130A, 130B are uplifted integrally with the lifting plate 110, and the rear ends 130R of the first lateral guides 130A, 130B enter the areas yielded by the inward corners 51A, 51B (see FIGS. 10 and 11). In other words, when the lifting plate 110 is in the approximate position, from a view point along the widthwise direction, the rear ends 130R of the first lateral guide 130A on the left and the first lateral guide 130B on the right partially overlap the conveyer-supporting frame 50 respectively. Therefore, the first lateral guides 130A, 130B are prevented from being interfered with by conveyer-supporting frame 50. Accordingly, the conveyer-supporting frame 50 and the first lateral guides 130A, 130B can be placed to be vertically close to each other. Thus, with the sheet conveyer 1 in the present embodiment, the manufacturing cost can be reduced, and the sheet conveyer 1 may be vertically downsized effectively.

In the sheet conveyer 1, the lifting plate 110 is swingable about the swing axis X1; therefore, with the rear end 110R of the lifting plate 110 vertically movable in the lower position with respect to the feed roller 11, the lifting plate 110 can moved between the approximate position and the separated position easily.

In the sheet conveyer 1, the conveyer-supporting frame 50 is formed to have the conveyer-housing space 50S. The conveyer-housing space 50S is arranged in the position close to the rear-side wall 8R of the body 8 and holds the feed roller 11 and the separator roller 12 thereat. With this arrangement, the sheet conveyer 1 can be downsized in the direction of depth from the front-side wall 8F toward the rear-side wall 8R in the body 8.

In the sheet conveyer 1, the first lateral guides 130A, 130B are arranged in the positions to place the rear ends 130R thereof below the feed roller 11. In other words, the first lateral guides 130A, 130B extend to the positions below the feed roller 11. Therefore, by the first lateral guides 130A, 130B in the positions approximate to the feed roller 11, the sheets 99 may be placed in the correct widthwise position on the lifting plate 110 effectively. Accordingly, the sheets 99 may be fed by the feed roller 11 stably, and even without the registration roller, the sheets 99 can be prevented from being conveyed in a skewed orientation with respect to the image forming unit 20. Further, with the inward corners 51A, 51B, which enable the first lateral guides 130A, 130B to be uplifted to the higher positions even with the presence of the conveyer-supporting frame 50, the sheet conveyer 1 can be effectively downsized in the vertical direction.

In the sheet conveyer 1, the rear ends 130R of the first lateral guides 130A, 130B are in the positions to vertically overlap the frictional piece 118 on the lifting plate 110. In other words, the first lateral guides 130A, 130B extend to reach the positions vertically overlap the frictional piece 118. With this arrangement in relation with the first lateral guides 130A, 130B and the frictional piece 118, the sheets 99 on the lifting plate 110 can be placed in the correct widthwise position accurately on the lifting plate 110. Accordingly, the sheets 99 can be conveyed by the feed roller 11 even more stably.

In the sheet conveyer 1, the front ends 130F of the first lateral guides 130A, 130B are in the positions approximately straight above the shaft support 8H. Therefore, the first lateral guides 130A, 130B extend throughout a large part of the body 8 along the front-rear direction from the front side closer to the front-side wall 8F of the body 8 to the rear side closer to the rear-side wall 8R of the body 8. In other words, a larger part of the sheets 99 are held by the first lateral guides 130A, 130B along the front-rear direction in the body 8. Therefore, the sheets 99 can be effectively and accurately placed in the correct position on the lifting plate 110. Further, with the inward corners 51A, 51B, which enable the first lateral guides 130A, 130B to be uplifted to the higher positions even with the presence of the conveyer-supporting frame 50, the sheet conveyer 1 can be effectively downsized in the vertical direction.

In the sheet conveyer 1, the first lateral guides 130A, 130B are movable within the widthwise range, in which the sheets 99 having a widthwise dimension larger than the first width W1 can be set and used. Further, with the second placement unit 200, the sheets 99 with the second width W2 being smaller than the first width W1 can be set and used. Meanwhile, the widthwise dimension of the inclined part 202 is, as well as the second width W2, smaller than the first width W1. Therefore, as shown in FIGS. 7 and 9, when the lifting plate 110 is in the approximate position, the first lateral guides 130A, 130B are placed in the laterally outer positions of the inclined part 202 of the second placement unit 200. With this arrangement, the first lateral guides 130A, 130B can be placed in the vertically closer positions to the second placement unit 200 compared to lateral guides, which might vertically interfere with the inclined part 202. Accordingly, the sheet conveyer 1 can be effectively downsized in the vertical direction.

In the sheet conveyer 1, the second placement unit 200 is removable from the body 8 through the opening 89. Therefore, by removing the second placement unit 200, the sheet 99 jammed in the first placement unit 100 can be accessed through the opening 89 and removed easily. Further, even when the sheet 99 is jammed in the second placement unit 200, by removing the second placement unit 200 together with the jammed sheet 99, the jammed sheet 99 can be easily removed from the second placement unit 200 outside the body 8.

In the sheet conveyer 1, the second placement unit 200 is arranged to have the front end 200F in the higher position with respect to the rear end 200R. In this arrangement, the front end 200F is separated upward from the first placement unit 100, and a larger room can be reserved above the first placement unit 100. Therefore, the sheets 99 can be stacked easily on the first placement unit 100 using benefit of the larger room.

In the sheet conveyer 1, the second placement unit 200 includes the horizontal part 201 and the inclined part 202. Therefore, the space inside the body 8 may be used effectively, and the vertical dimension of the sheet conveyer 1 can be reduced more easily compared to a second placement unit, which is arranged to incline linearly straight from the front end 200F to the rear end 200R.

The second placement unit 200 provides the horizontal part 201 to form the guided part 201G, which enables detachable attachment of the second placement unit 200 to the body 8. Meanwhile, when the lifting plate 110 is in the approximate position, the first lateral guides 130A, 130B are placed in the lateral outside positions with respect to the inclined part 202 of the second placement unit 200 so that the first lateral guides 130A, 130B are prevented from being interfered with by the inclined part 202. Thus, the shape of the second placement unit 200 including the horizontal part 201 and the inclined part 202 is effectively utilized.

In the sheet conveyer 1, the handle 170 is formed to have the bended shape and is in the position to horizontally overlap the inclined part 202 when viewed along the front-rear direction to face the front-side wall 8F of the body 8 (see FIG. 2). With this form and the arrangement, operability of the first lateral guides 130A, 130B with the handle 170 is secured while the handle 170 can be downsized. Accordingly, the handle 170 can be accommodated securely in the space reserved in the lower position with respect to the horizontal part 201.

The image forming apparatus 3 with the sheet conveyer 1 can also be benefited from the effects available from the sheet conveyer 1. Further, while a registration roller can be omitted from the image forming apparatus 3, a quantity of parts can be reduced, and space which might have been occupied by such omitted parts can be omitted. Therefore, the image forming apparatus 3 may be manufactured in lower costs and may be downsized effectively.

Meanwhile, the first lateral guides 130A, 130B are formed to extend longitudinally along the front-rear direction and are arranged to place the rear ends 130R thereof in the positions below the feed roller 11 and to place the front ends 130F thereof in the positions above the shaft support 8F. Therefore, the leading ends of the sheets 99 can be guided correctly by the first lateral guides 130A, 130B, and the sheets 99 can be conveyed in the conveyer path P1 in the correct orientation even without being restricted at the leading ends thereof. Therefore, image forming on the sheets 99 being conveyed in the skewed orientation can be prevented.

In the image forming apparatus 3, as shown in FIG. 11, the cutout 130C is formed in the first lateral guide 130B on the right. Therefore, collision between the first lateral guide 130B on the right and the jut 21A of the processing cartridge 21 is prevented, and the image forming apparatus 3 may be downsized in the vertical direction.

Although an example of carrying out the invention have been described, those skilled in the art will appreciate that there are numerous variations and permutations of the sheet conveyer and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the first placement unit 100 may be replaced with a sheet cassette, which is detachably attached to the body 8 and has a lifting plate 110 movable between the separated position and the approximate position.

For another example, the inward corners 51A, 51B may be replaced with dents, which dent upwardly from a lower plane of the conveyer-supporting frame 50, or vertically penetrating holes to accommodate the rear ends 130R of the first lateral guides 130A, 130B when the lifting plate 110 is placed in the approximate position.

For another example, the lifting plate 110 may not necessarily be swingable about the swing axis X1 but may be vertically movable without being tilted.

For another example, the rear ends 130R of the first lateral guides 130A, 130B may not necessarily be placed in the positions below the feed roller 11 but may be placed in positions closer to a depth (front-rear) center of the sheet conveyer 1.

For another example, the front ends 130F of the first lateral guides 130A, 130B may not necessarily be placed in the positions approximate to the shaft support 8H but may be placed in farther separated positions from the shaft support 8H.

For another example, the second placement unit 200 may not necessarily be formed to have the horizontal part 201 and the inclined part 202 but may be formed linearly to incline straight from the front end 200F to the rear end 200R.

For another example, the conveyer 10 may not necessarily have the feed roller 11 and the separator roller 12 but may be, for example, equipped with the feed roller 11 or with the separator roller 12 alone. For another example, the conveyer 10 may have a single roller, which can both feed and separate.

What is claimed is:

1. A sheet conveyer, comprising:

a body comprising a conveyer path formed therein;

a conveyer arranged in an upstream position in the conveyer path along a direction of sheet conveyance in the body and configured to convey a sheet into the conveyer path;

a first lateral frame disposed inside the body;

a second lateral frame disposed inside the body;

a conveyer-supporting frame arranged between the first lateral frame and the second lateral frame in the body and configured to support the conveyer between the first lateral frame and the second lateral frame in the body, the conveyer-supporting frame extending longitudinally in a widthwise direction transverse to the direction of sheet conveyance in the body and including a first longitudinal end connected to the first lateral frame and a second longitudinal end connected to the second lateral frame;

a first placement unit arranged between the first lateral frame and the second lateral frame in the body and comprising a lifting plate, the lifting plate being movable between a separated position, in which the lifting plate is separated downwardly from the conveyer, and an approximate position, in which the lifting plate is uplifted to be closer to the conveyer, the sheet to be conveyed into the conveyer path being placed on the lifting plate; and a lateral guide slidably arranged on the lifting plate along the widthwise direction transverse to the direction of sheet conveyance in the body and configured to restrict a widthwise position of the sheet placed on the lifting plate, the lateral guide being movable integrally with the lifting plate between the separated position and the approximate position, wherein the conveyer is configured to contact the sheet placed on the first placement unit, when the lifting plate is in the approximate position and convey the sheet into the conveyer path, and wherein the conveyer-supporting frame is formed to have an interference-avoidable dented section, in which the lateral guide on the lifting plate placed in the approximate position is allowed to enter partly to avoid interference with the conveyer-supporting frame;

the sheet conveyor further comprising:

a second placement unit arranged in an upper position with respect to the first placement unit in the body and on which a second sheet to be conveyed into the conveyer path is placed, wherein the conveyer is configured to contact the second sheet placed on the second placement unit, when the lifting plate is in the approximate position, and convey the second sheet into the conveying path;

wherein the lateral guide is movable along the widthwise direction of the sheet within a first range;

wherein the second placement unit comprises a second lateral guide, which is arranged on the second placement unit slidably along a widthwise direction of the second sheet placed on the second placement unit and is configured to restrict a widthwise position of the second sheet on the second placement unit;

wherein the second lateral guide is movable along the widthwise direction of the second sheet within a second range; and wherein the second range, within which the second lateral guide is movable, is larger than the first range, within which the lateral guide is movable.

2. The sheet conveyer according to claim 1, wherein the lifting plate is arranged in the body to extend from a first side of the body toward a second side opposite from the first side and swingably supported at a first end closer to the first side to swing about a swing axis, which extends in parallel with the widthwise direction; and wherein a second end of the lifting plate closer to the second side of the body is vertically movable by a swing movement of the lifting plate in a lower position with respect to the conveyer.

3. The sheet conveyer according to claim 2, wherein the conveyer includes a feed roller and a separator roller, which are arranged in neighboring positions from the second side of the body and configured to convey the sheet placed on the first placement unit separately into the conveyer path; and wherein at least a part of the conveyer-supporting frame is arranged in a neighboring position from the second side and holds the conveyer.

4. The sheet conveyer according to claim 3, wherein a second-side end of the lateral guide closer to the second side of the body is in a neighboring position from the feed roller.

5. The sheet conveyer according to claim 4, further comprising:

a frictional piece arranged on the second end of the lifting plate in a position to face the feed roller when the lifting plate without the sheet thereon is in the approximate position, wherein the second-side end of the lateral guide is in a position to vertically overlap the frictional piece when viewed along the widthwise direction.

6. The sheet conveyer according to claim 4, further comprising:

a second placement unit arranged in an upper position with respect to the first placement unit in the body and on which a second sheet to be conveyed into the conveyer path is placed, wherein the conveyer is configured to contact the second sheet placed on the second placement unit, when the lifting plate is in the approximate position, and convey the second sheet into the conveying path;

wherein the lateral guide is movable along the widthwise direction within a range, which is allowable as a width of the sheet, having a width greater than or equal to a first width, to be placed in a correct widthwise position on the lifting plate; and wherein the second placement unit is usable to place the second sheet having a second width being smaller than the first width thereon; and wherein the second placement unit is formed in a shape to prevent interference with the lateral guide when the lifting plate is in the approximate position.

7. The sheet conveyer according to claim 6, wherein the body is formed to have an opening on the first side; and wherein the second placement unit is attachable to and detachable from the body through the opening.

8. The sheet conveyer according to claim 7, wherein the second placement unit is arranged in the body to be higher at a first end thereof closer to the first side of the body than a second end thereof closer to the second side of the body.

9. The sheet conveyer according to claim 8, wherein the second placement unit comprises a horizontal part, which extends horizontally from the first end thereof, and an inclined part, which extends to incline downward from the horizontal part to the second end thereof.

10. The sheet conveyer according to claim 9, wherein the body comprises a guiding member configured to guide the second placement unit when the second placement unit is one of attached to and detached from the body; and wherein the second placement unit comprises a guided part, which is guided by the guiding member of the body, in the horizontal part.

11. The sheet conveyer according to claim 8, further comprising:

a handle configured to manipulate the lateral guide, wherein the handle is formed to extend from an upper end of the lateral guide inwardly toward a widthwise center of the body and curved upwardly to extend vertically to be closer to the first side of the body; and wherein the handle is arranged to partially overlap the second placement unit when viewed along a direction to face the first side of the body.

12. The sheet conveyer according to claim 4, wherein the second end of the lifting plate is swingably supported by a supporting member arranged in the body to swing about the swing axis; and wherein a first-side end of the lateral guide closer to the first side of the body is arranged in a neighboring position from the supporting member.

13. The sheet conveyer according to claim 1, wherein the conveyer-supporting frame comprises:

a portion disposed between the first and second longitudinal ends in a central position in the widthwise direction transverse to the direction of sheet conveyance in the body is configured to support the conveyer, the portion disposed in the central position having a depth measured in a direction perpendicular to the widthwise direction that is greater than a depth of the conveyer-supporting frame at the first and second longitudinal ends measured in the direction perpendicular to the widthwise direction.

14. An image forming apparatus, comprising:

a body comprising a conveyer path formed therein;

an image forming unit arranged along the conveyer path and configured to form an image on a sheet being conveyed in the conveyer path;

a sheet conveyer, comprising:

a conveyer arranged in an upstream position in the conveyer path along a direction of sheet conveyance in the body and configured to convey the sheet into the conveyer path;

a first lateral frame disposed inside the body;

a second lateral frame disposed inside the body;

a conveyer-supporting frame arranged between the first lateral frame and the second lateral frame in the body and configured to support the conveyer between the first lateral frame and the second lateral frame in the body, the conveyer-supporting frame extending longitudinally in a widthwise direction transverse to the direction of sheet conveyance in the body and including a first longitudinal end connected to the first lateral frame and a second longitudinal end connected to the second lateral frame;

a first placement unit arranged between the first lateral frame and the second lateral frame in the body and comprising a lifting plate, the lifting plate being movable between a separated position, in which the lifting plate is separated downwardly from the conveyer, and an approximate position, in which the lifting plate is uplifted to be closer to the conveyer, the sheet to be conveyed into the conveyer path being placed on the lifting plate; and a lateral guide slidably arranged on the lifting plate along the widthwise direction transverse to the direction of sheet conveyance in the body and configured to restrict a widthwise position of the sheet placed on the lifting plate, the lateral guide being movable integrally with the lifting plate between the separated position and the approximate position, wherein the conveyer is configured to contact the sheet placed on the first placement unit, when the lifting plate is in the approximate position, and convey the sheet into the conveyer path; and wherein the conveyer-supporting frame is formed to have an interference-avoidable dented section, in which the lateral guide on the lifting plate placed in the approximate position is allowed to enter partly to avoid interference with the conveyer-supporting frame;

the sheet conveyor further comprising:

a second placement unit arranged in an upper position with respect to the first placement unit in the body and on which a second sheet to be conveyed into the conveyer path is placed, wherein the conveyer is configured to contact the second sheet placed on the second placement unit, when the lifting plate is in the approximate position, and convey the second sheet into the conveying path;

wherein the lateral guide is movable along the widthwise direction of the sheet within a first range;

wherein the second placement unit comprises a second lateral guide, which is arranged on the second placement unit slidably along a widthwise direction of the second sheet placed on the second placement unit and is configured to restrict a widthwise position of the second sheet on the second placement unit;

wherein the second lateral guide is movable along the widthwise direction of the second sheet within a second range; and wherein the second range, within which the second lateral guide is movable, is larger than the first range, within which the lateral guide is movable.

15. The image forming apparatus according to claim 14, wherein the image forming unit comprises:

a photosensitive member configured to carry a toner image;

a developer roller configured to develop an electrostatic image formed on the photosensitive member to be the toner image;

a supplier roller configured to supply toner to the developer roller;

a container configured to contain the toner to be supplied to the developer roller; and a transfer member configured to transfer the toner image onto the sheet being conveyed in the conveyer path, wherein the lateral guide is formed to have a cutout, which prevents interference with the image forming unit when the lifting plate is in the approximate position.

16. The image forming apparatus according to claim 14, wherein the conveyer-supporting frame comprises:

a portion disposed between the first and second longitudinal ends in a central position in the widthwise direction transverse to the direction of sheet conveyance in the body is configured to support the conveyer, the portion disposed in the central position having a depth measured in a direction perpendicular to the widthwise direction that is greater than a depth of the conveyer-supporting frame at the first and second longitudinal ends measured in the direction perpendicular to the widthwise direction.

17. A sheet conveyer, comprising:

a body comprising a conveyer path formed therein;

a conveyer arranged in an upstream position in the conveyer path along a direction of sheet conveyance in the body and configured to convey the sheet into the conveyer path;

a first lateral frame disposed inside the body;

a second lateral frame disposed inside the body;

a conveyer-supporting frame arranged between the first lateral frame and the second lateral frame in the body and configured to support the conveyer between the first lateral frame and the second lateral frame in the body, the conveyer-supporting frame extending longitudinally in a widthwise direction transverse to the direction of sheet conveyance in the body and including a first longitudinal end connected to the first lateral frame and a second longitudinal end connected to the second lateral frame;

a first placement unit arranged between the first lateral frame and the second lateral frame in the body and comprising a lifting plate, the lifting plate being movable between a separated position, in which the lifting plate is separated downwardly from the conveyer, and an approximate position, in which the lifting plate is uplifted to be closer to the conveyer, the sheet to be conveyed into the conveyer path being placed on the lifting plate; and a lateral guide slidably arranged on the lifting plate along the widthwise direction transverse to the direction of sheet conveyance in the body and configured to restrict a widthwise position of the sheet placed on the lifting plate, the lateral guide being movable integrally with the lifting plate between the separated position and the approximate position, wherein the conveyer is configured to contact the sheet placed on the first placement unit, when the lifting plate is in the approximate position, and convey the sheet into the conveyer path; and wherein the conveyer-supporting frame and the lateral guide partially overlap each other horizontally along the widthwise direction when the lifting plate is in the approximate position;

the sheet conveyor further comprising:

a second placement unit arranged in an upper position with respect to the first placement unit in the body and on which a second sheet to be conveyed into the conveyer path is placed, wherein the conveyer is configured to contact the second sheet placed on the second placement unit, when the lifting plate is in the approximate position, and convey the second sheet into the conveying path;

wherein the lateral guide is movable along the widthwise direction of the sheet within a first range;

wherein the second placement unit comprises a second lateral guide, which is arranged on the second placement unit slidably along a widthwise direction of the second sheet placed on the second placement unit and is configured to restrict a widthwise position of the second sheet on the second placement unit;

wherein the second lateral guide is movable along the widthwise direction of the second sheet within a second range; and wherein the second range, within which the second lateral guide is movable, is larger than the first range, within which the lateral guide is movable.

18. The sheet conveyer according to claim 17, wherein the conveyer-supporting frame comprises:

a portion disposed between the first and second longitudinal ends in a central position in the widthwise direction transverse to the direction of sheet conveyance in the body is configured to support the conveyer, the portion disposed in the central position having a depth measured in a direction perpendicular to the widthwise direction that is greater than a depth of the conveyer-supporting frame at the first and second longitudinal ends measured in the direction perpendicular to the widthwise direction.

19. A sheet conveyer, comprising:

a body comprising a conveyer path formed therein;

a conveyer arranged in an upstream position in the conveyer path along a direction of sheet conveyance in the body and configured to convey a sheet into the conveyer path;

a first lateral frame disposed inside the body;

a second lateral frame disposed inside the body;

a conveyer-supporting frame arranged between the first lateral frame and the second lateral frame in the body and configured to support the conveyer between the first lateral frame and the second lateral frame in the body, the conveyer-supporting frame extending longitudinally in a widthwise direction transverse to the direction of sheet conveyance in the body and including a first longitudinal end connected to the first lateral frame and a second longitudinal end connected to the second lateral frame;

a first placement unit arranged between the first lateral frame and the second lateral frame in the body and comprising a lifting plate, the lifting plate being movable between a separated position, in which the lifting plate is separated downwardly from the conveyer, and an approximate position, in which the lifting plate is uplifted to be closer to the conveyer, the sheet to be conveyed into the conveyer path being placed on the lifting plate;

a lateral guide slidably arranged on the lifting plate along the widthwise direction transverse to the direction of sheet conveyance in the body and configured to restrict a widthwise position of the sheet placed on the lifting plate, the lateral guide being movable integrally with the lifting plate between the separated position and the approximate position, wherein the conveyer is configured to contact the sheet placed on the first placement unit, when the lifting plate is in the approximate position and convey the sheet into the conveyer path, wherein the conveyer-supporting frame is formed to have an interference-avoidable dented section, in which the lateral guide on the lifting plate placed in the approximate position is allowed to enter partly to avoid interference with the conveyer-supporting frame;

wherein the lifting plate is arranged in the body to extend from a first side of the body toward a second side opposite from the first side and swingably supported at a first end closer to the first side to swing about a swing axis, which extends in parallel with the widthwise direction;

wherein a second end of the lifting plate closer to the second side of the body is vertically movable by a swing movement of the lifting plate in a lower position with respect to the conveyer;

wherein the conveyer includes a feed roller and a separator roller, which are arranged in neighboring positions from the second side of the body and configured to convey the sheet placed on the first placement unit separately into the conveyer path;

wherein at least a part of the conveyer-supporting frame is arranged in a neighboring position from the second side and holds the conveyer; and wherein a second-side end of the lateral guide closer to the second side of the body is in a neighboring position from the feed roller;

the sheet conveyor further comprising a frictional piece arranged on the second end of the lifting plate in a position to face the feed roller when the lifting plate without the sheet thereon is in the approximate position;

wherein the second-side end of the lateral guide is in a position to vertically overlap the frictional piece when viewed along the widthwise direction.

20. The sheet conveyer according to claim 19, further comprising:

a second placement unit arranged in an upper position with respect to the first placement unit in the body and on which a second sheet to be conveyed into the conveyer path is placed, wherein the conveyer is configured to contact the second sheet placed on the second placement unit, when the lifting plate is in the approximate position, and convey the second sheet into the conveying path;

wherein the lateral guide is movable along the widthwise direction of the sheet within a first range;

wherein the second placement unit comprises a second lateral guide, which is arranged on the second placement unit slidably along a widthwise direction of the second sheet placed on the second placement unit and is configured to restrict a widthwise position of the second sheet on the second placement unit;

wherein the second lateral guide is movable along the widthwise direction of the second sheet within a second range; and wherein the second range, within which the second lateral guide is movable, is larger than the first range, within which the lateral guide is movable.

21. The sheet conveyer according to claim 19, wherein the conveyer-supporting frame comprises:

a portion disposed between the first and second longitudinal ends in a central position in the widthwise direction transverse to the direction of sheet conveyance in the body is configured to support the conveyer, the portion disposed in the central position having a greater dimension than the first and second longitudinal ends in the direction of sheet conveyance.

* * * * *